US005605132A

United States Patent [19]

Hori et al.

[11] Patent Number: 5,605,132

[45] Date of Patent: Feb. 25, 1997

[54] CONTROL METHOD AND CONTROLLER FOR ENGINE

[75] Inventors: Toshio Hori; Takeshi Atago, both of Katsuta; Nobuo Kurihara, Hitachiota; Hiroshi Kimura; Kimio Hoshi, both of Katsuta, all of Japan

[73] Assignee: Hitachi, Ltd., Japan

[21] Appl. No.: 570,244

[22] Filed: Dec. 11, 1995

Related U.S. Application Data

[63] Continuation of Ser. No. 234,156, Apr. 28, 1994, abandoned.

[30] Foreign Application Priority Data

Apr. 27, 1993 [JP] Japan ..... 5-100711
Aug. 6, 1993 [JP] Japan ..... 5-195823

[51] Int. Cl.[6] ..... F02D 41/04; F02P 5/15

[52] U.S. Cl. ..... 123/419; 123/436

[58] Field of Search ..... 123/419, 425, 123/435, 493, 673, 674

[56] References Cited

U.S. PATENT DOCUMENTS 4,934,328 6/1990 Ishii et al. ..... 123/673
5,069,183 12/1991 Nagano et al. ..... 123/419
5,131,372 7/1992 Nakaniwa ..... 123/673
5,287,282 2/1994 Imai ..... 123/419
5,361,629 11/1994 MsCombie ..... 123/419

FOREIGN PATENT DOCUMENTS 58-217732 12/1983 Japan .
59-122763 7/1984 Japan .
283835 11/1990 Japan ..... 123/673

*Primary Examiner*—Willis R. Wolfe
*Attorney, Agent, or Firm*—Evenson, McKeown, Edwards & Lenahan P.L.L.C.

[57] ABSTRACT

An engine control method and apparatus wherein a combustion state in each cylinder of an internal combustion engine is detected based on the fluctuation the rotating angular speed of an engine. A correction control is performed to make the combustion states in each of the cylinders uniform, followed by the base value for the purpose of correction control is obtained when the fluctuation in the rotating angular speed is small.

13 Claims, 18 Drawing Sheets

| | | | | |
|---|---|---|---|---|
| | SCRi1 | SCRi5 | SCRi9 | SCRi13 |
| ENGINE LOAD | SCRi2 | SCRi6 | SCRi10 | SCRi14 |
| | SCRi3 | SCRi7 | SCRi11 | SCRi15 |
| | SCRi4 | SCRi8 | SCRi12 | SCRi16 |

ENGINE SPEED

CONTROL METHOD AND CONTROLLER FOR ENGINE

This application is a continuation of application Ser. No. 08/234,156, filed Apr. 28, 1994, abandoned.

BACKGROUND OF THE INVENTION

1. Field of the Invention

The present invention relates to a control method and apparatus for controlling an engine, and in particular, controlling the combustion state of each of the cylinders in a desirable manner.

2. Description of the Prior Art

Japanese Patent Application Laid-Open No. 59-122763 (1984) discloses a method and apparatus of this generic type, for controlling combustion state in each cylinder of an engine. Therein, the rotating angular speed at an explosion cycle is detected in each of cylinders, and the combustion state is controlled based on the difference of the angular speed in each of cylinders.

In such a conventional technology, the combustion state is determined by comparing, for example, the angular speed of each of the cylinders. Therefore, this technology has the disadvantage that the-combustion state cannot be judged correctly because the combustion state of the other cylinder becomes a a source of error in the comparison. Moreover, it is not taken into consideration that the engine is brought to a better state after the deviation in combustion state in each of the cylinders is corrected.

Further, as disclosed in Japanese Patent Application Laid-Open No. 58-217732 (1983), control parameters for ignition and/or fuel injection are corrected to improve combustion when the variation in rotating angular speed is large.

Moreover, each of the foregoing control methods and controllers requires that the accuracy of a sensor detecting rotational speed be sufficiently higher than the accuracy required for the control, and no corrective measures are provided when the accuracy in rotating information detection deviates depending on the individual differences of the sensors.

SUMMARY OF THE INVENTION

An object of the present invention is to decrease $NO_x$ emissions of an internal combustion engine, and to stabilize combustion by correcting variations in combustion state of each of the cylinders and controlling the average combustion state in all the cylinders in a desirable manner.

Another object of the present invention is to minimize the detection error due to the individual differences in the sensors for detecting the rotation of engine.

A further object of the present invention is to provide a method and apparatus for combustion control which is not affected by the individual differences in the rotating detection sensors.

One characteristic of the control method according to the present invention is as follows.

A control method for an engine, which comprises the steps of:

(a) determining a combustion state parameter indicating a combustion state in each of the cylinders of an engine;

(b) determining all average combustion state parameter for the combustion state parameters determined for each of the cylinders in order to get information on the overall combustion state;

(c) judging the combustion state in each of the cylinders by comparing the average combustion state parameter with the combustion state parameter of each of the cylinders; and (d) controlling the combustion state in each of the cylinders based on the result of the judgment.

Another characteristic of the control method according to the present invention is as follows.

A control method for an engine, which comprises the steps of:

(a) determining a combustion state parameter indicating a combustion state in each of the cylinders of an engine;

(b) determining an average combustion state parameter from the combustion state parameters determined for each of the cylinders in order to get information on the overall combustion state;

(c) determining that the combustion state in each cylinders is not in a desired state when the difference between the combustion state parameter the cylinder and the average combustion state parameter exceeds a first given value, and when the difference between the combustion state parameter of such cylinder and said average combustion state parameter exceeds a second given value; and (d) controlling the combustion state in each of cylinders based on the result of the judgment.

A further characteristic of the control method according to the present invention is as follows.

A control method for an engine, which comprises the steps of:

(a) determining a combustion state parameter indicating a combustion state in each of the cylinders of an engine;

(b) determining an average combustion state parameter from the combustion state parameters of each of the cylinders in order to get information on the overall combustion state;

(c) judging the combustion state in each of the cylinders by comparing the average combustion state parameter of each of the cylinders;

(d) controlling the combustion state in each of cylinders based on the result of the judgment;

(e) judging the overall combustion state of the cylinders by comparing the average combustion state parameter with a given judging value; and (f) controlling the overall combustion state of the cylinders based on the result of said judgment.

Even further characteristic of the control method according to the present invention is as follows.

A control method for an engine, which comprises the steps of:

(a) determining a combustion state parameter indicating a combustion state in each of the cylinders of an engine;

(b) determining an average combustion state parameter from the combustion state parameters of each of the cylinders in order to get information on the overall combustion state;

(c) judging the combustion state in each of the cylinders by comparing the average combustion state parameter with the combustion state parameter of each of the cylinders;

(d) controlling the combustion state in each of the cylinders based on the result of the judgment; and (e) judging whether or not the overall combustion state in the total cylinders is within a given combustion state region by comparing said average combustion state parameter with a given first judging value and a given second judging value; and (f) controlling the overall combustion state of the cylinders based on the result of such judgment so as to enter into the given combustion state region.

A further characteristic of the controller according to the present invention is as follows.

A controller for an engine, which comprises:

(a) means for determining a combustion state parameter indicating a combustion state in each of the cylinders of an engine;

(b) means for determining an average combustion state parameter from the combustion state parameters of each of the cylinders in order to get information on the overall combustion state;

(c) means for judging the combustion state in each of the cylinders by comparing the average combustion state parameter with the combustion state parameter of each of the cylinders; and (d) means for controlling the combustion state in each of the cylinders based on the result of the judgment.

A further characteristic of the controller according to the present invention is as follows.

A controller for an engine, which comprises:

(a) means for determining a combustion state parameter indicating a combustion state in each of the cylinders of an engine;

(b) means for determining an average combustion state parameter from the combustion state parameters of each of the cylinders in order to get information on the overall combustion state;

(c) means for judging the combustion state in each of the cylinders by comparing the average combustion state parameter with the combustion state parameter of each of the cylinders;

(d) means for controlling the combustion state in each of the cylinders based on the result of the judgment;

(e) means for judging the overall combustion state of the cylinders by comparing the average combustion state parameter with a given judging value; and (f) means for controlling the overall combustion state of the cylinders based on the result of said judgment.

A further characteristic of a control method according to the present invention is as follows.

A control method for an engine where a combustion state of an engine is quantitatively detected to perform a fuel correction for improving the combustion, which comprises the steps of:

(a) determining a value of parameter indicating the combustion state under a base combustion state as a base value; and (b) determining the degradation of the combustion state by comparing a parameter indicating each of combustion states of the engine with said base value.

A further characteristic of a controller according to the present invention is as follows.

A controller for an engine where a combustion state of an engine is quantitatively detected to perform a fuel correction for improving the combustion, which comprises:

(a) means for determining a parameter indicating the combustion state of the engine;

(b) means for keeping a parameter indicating the combustion state under a base combustion state as a base value; and (c) means for judging the degradation of combustion state by comparing a parameter indicating each of combustion states of the engine with the base value.

A further characteristic of a control method according to the present invention is as follows.

A control method for operating an engine where a combustion state of an engine is quantitatively detected based on rotational information of the engine to perform a fuel correction for improving the combustion, wherein:

output information from a sensor for detecting the rotating variation state under a given operating state of the engine is corrected.

A further characteristic of the control method according to the present invention is as follows.

A control method for an engine, which comprises the steps of:

(a) determining a combustion state parameter indicating a combustion state in each of the cylinders of an engine;

(b) storing a value of a parameter indicating the combustion state in each of the cylinders under a base combustion state as a learned value;

(c) correcting the combustion state parameter determined for each of the cylinders with the learned value;

(d) obtaining an average combustion state parameter from the combustion state parameters of each of the cylinders in order to get information on the total combustion state;

(e) judging the combustion state in each of the cylinders by comparing the average combustion state parameter with the combustion state parameter of each of the cylinders; and (f) controlling the combustion state in each of the cylinders based on the result of the judgment.

A further characteristic of the control method according to the present invention is as follows.

A control method for an engine, which comprises the steps of:

(a) determining a combustion state parameter indicating a combustion state in each of the cylinders of an engine;

(b) storing a value of a parameter indicating the combustion state in each of the cylinders under a base combustion state as a learned value;

(c) correcting a combustion state parameter determined for each of the cylinders with the learned value;

(d) determining an average combustion state parameter from the corrected combustion state parameters of each of the cylinders in order to get information on the overall combustion state;

(e) judging the combustion state in each of the cylinders by comparing the average combustion state parameter with the combustion state parameter of each of the cylinders;

(f) controlling the combustion state in each of the cylinders based on the result of the judgment;

(g) judging the overall combustion state of the cylinders by means of comparing the average combustion state parameter with a given judging value; and (h) controlling the overall combustion state of the cylinders based on the result of said judgment.

In the control by these steps and methods, judgment of the combustion state of each of the cylinders is performed by comparing the average value of the combustion state parameters for all the cylinders with the value for each of the cylinders to perform correction in each of the cylinders individually. It is preferable to perform the overall correction for all cylinders after all the differences between the average value and the value for each of the cylinders are less than a given value.

Further, according to the invention errors in the detection of rotational speed caused by variations in the individual rotation sensors are learned, and the parameters indicating the combustion stability are corrected based on the values.

Other objects, advantages and novel features of the present invention will become apparent from the following detailed description of the invention when considered in conjunction with the accompanying drawings.

DETAILED DESCRIPTION OF THE PREFERRED EMBODIMENTS

The fuel injection controller according to the present invention will be described below in detail, referring to the figures of embodiments.

Figure 2:
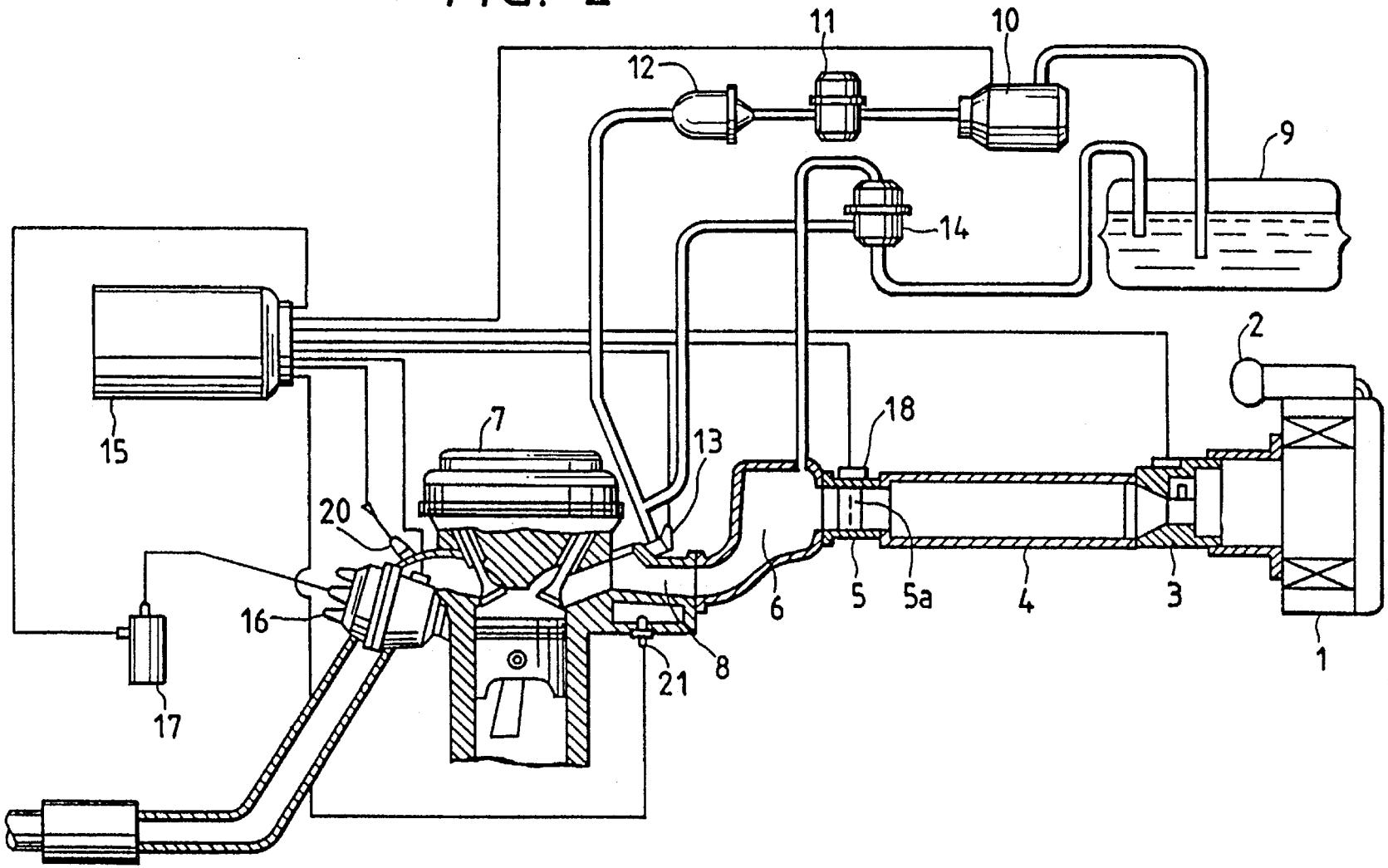
FIG. 2 is a block diagram of a system according to the present invention.

FIG. 2 shows an embodiment of an engine system according to the present invention. In this figure, the air to be sucked into an engine enters from an inlet part 2 of an air cleaner 1, flowing through a passage 4 and a throttle valve body 5 containing a throttle valve **5*a* for controlling suction air flow rate, entering into a collector 6. The sucked air is distributed to each suction pipes 8 connected to each of the cylinders of the engine 7** to be lead to the inside of each of the cylinders.

On the other hand, fuel such as gasoline is sucked from a fuel tank 9 with a fuel pump 10, being pumped to be supplied to a fuel system comprising a fuel damper 11, a fuel filter 12, a fuel injection valve (injector) 13 and a fuel pressure regulator 14 which are connected with each other by fuel lines. Then, the fuel is regulated at a constant pressure by the fuel pressure regulator 14 to be injected into the suction pipe 8 from the fuel injector 13 provided on the suction pipe 8.

An air flow meter 3 outputs an electric signal indicating the suction air flow rate, the output signal being input to a control unit 15.

A throttle sensor 18 for detecting opening of the throttle valve **5*a* is provided on the throttle valve body 5, the output signal being also input to the control unit 15**.

The numeral 16 indicates a distributor containing a crank angle sensor which generates a base angle signal REF indicating the rotational angular position of the crank shaft, and an angle signal POS indicating its rotational speed (rpm). These signals are also input to the control unit 15.

The numeral 20 indicates an air/fuel ratio sensor provided on an exhaust pipe to detect an actual operating air/fuel ratio. That is, the sensor detects whether the actual operating air/fuel ratio is in a rich state or in a lean state compared to a desirable air-fuel ratio, the signal being also input to the control unit 15.

The numeral 21 indicates a water temperature sensor for detecting an engine cooling water temperature, the signal being also input to the control unit 15.

Figure 3:
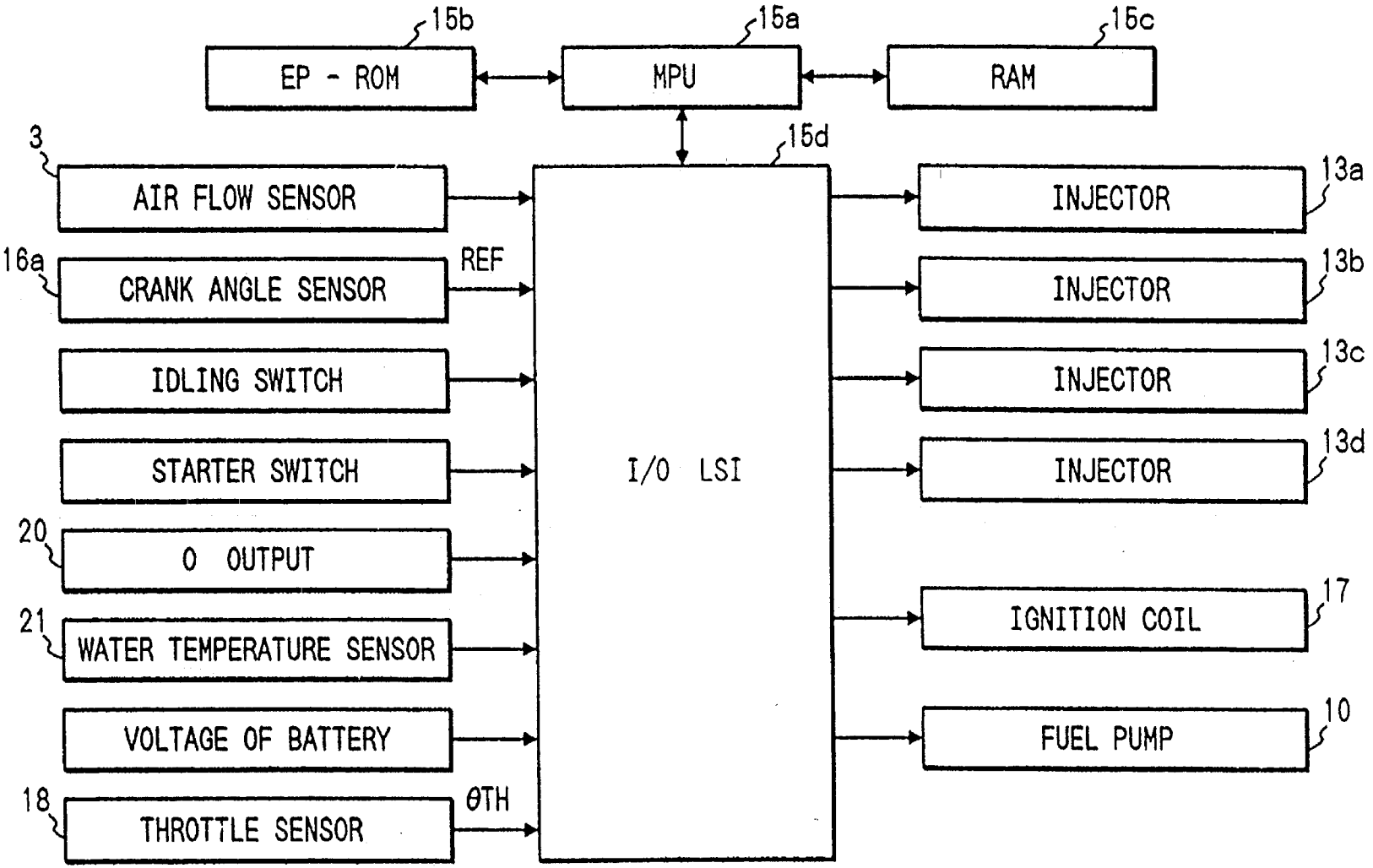
FIG. 3 is a block diagram of an engine controller according to the present invention.

The main portion of the control unit 15 comprises, as shown in FIG. 3, an MPU 15*a*, a ROM 15*b*, a RAM and an I/O LSI 15*d*, receiving output signals from said various sensors 3, 18, 20, 21 and the crank angle sensor 16*a* contained in the distributor 16 for detecting the operating state of the engine as output signals. Calculations based on these inputs are executed in the MPU, and various control signals generated as the result of the calculation are transmitted to the fuel injectors 13 (13*a* to 13*d*) and an ignition coil unit 17 to control the fuel supply rate and ignition timing.

Figure 4:
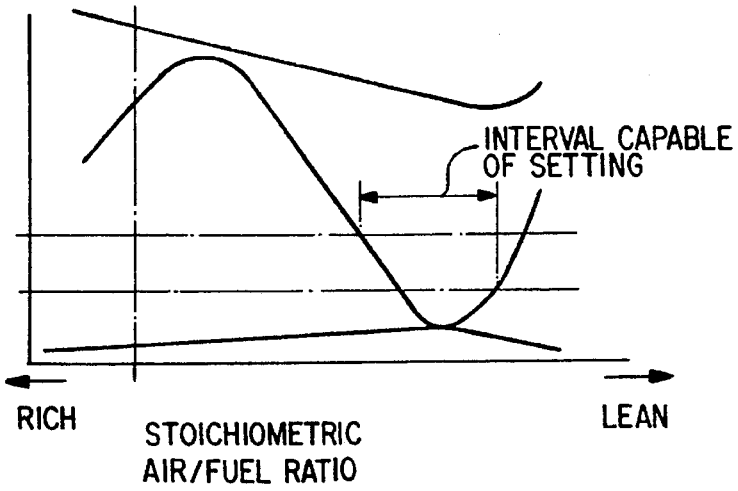
FIG. 4 is a characteristic graph showing the relationship between air/fuel ratio and engine performance.

In the engine of such a type, when the air/fuel ratio is set leaner than the theoretical (stoichiometric) air/fuel ratio, the fuel consumption rate, the $NO_x$ concentration and the torque fluctuation show the characteristics in FIG. 4. As used herein, the term "torque fluctuation" refers to variation or unevenness of the engine torque over time, as each of the respective cylinders fires. If one cylinder is operating at a different state than the others, the torque generated when it fires will be different, causing "torque fluctuation."

When the air/fuel ratio is shifted toward lean (with the torque and the fuel consumption rate kept constant), the fuel consumption rate, that is, the cost of fuel, is improved since pumping loss is decreased and specific heat is increased due to increasing of the suction air flow rate. The $No_x$ exhaust concentration is decreased due to decreasing of the combustion temperature as the air/fuel ratio becomes leaner. However, the combustion stability of the engine (that is, the extent to which each cylinder fires properly at the proper time), which is not shown in FIG. 4, but can be quantitatively estimated based on the torque fluctuation, gradually degrades with increasing air/fuel ratio up to a certain lean region, since the ignitability of mixing gas decreases due to the leanness of air/fuel ratio. And when the air/fuel ratio exceeds that point, the torque fluctuation rapidly increases since the ignitability degrades extremely. As described above, the combustion stability and the $NO_x$ exhausting concentration in the lean region largely depend on the air fuel ratio.

On the other hand, there is an allowable upper limit for $NO_x$ exhaust concentration based on the legal regulation on exhaust, and there is an upper limit on torque fluctuation (and a corresponding lower limit for combustion stability) from the requirement on operability. Therefore, in a lean air/fuel operation, it is required to operate an engine within the region defined by these two limits. Concurrently, in order to improve the cost of fuel, it is efficient to operate an engine at a point near the combustion stability limit.

However, as a practical matter, it is extremely difficult to control the air/fuel ratio for the fuel to be supplied to the engine due to the deviations in the fuel injectors 13 and the air flow meters 3, and due to the degradation by age, which leads to need of a closed loop control. An embodiment according to the present invention, which is capable of operating an engine within the region satisfying the above two limiting conditions ($NO_x$ emissions and torque fluctuation) will be described below.

Figure 5:
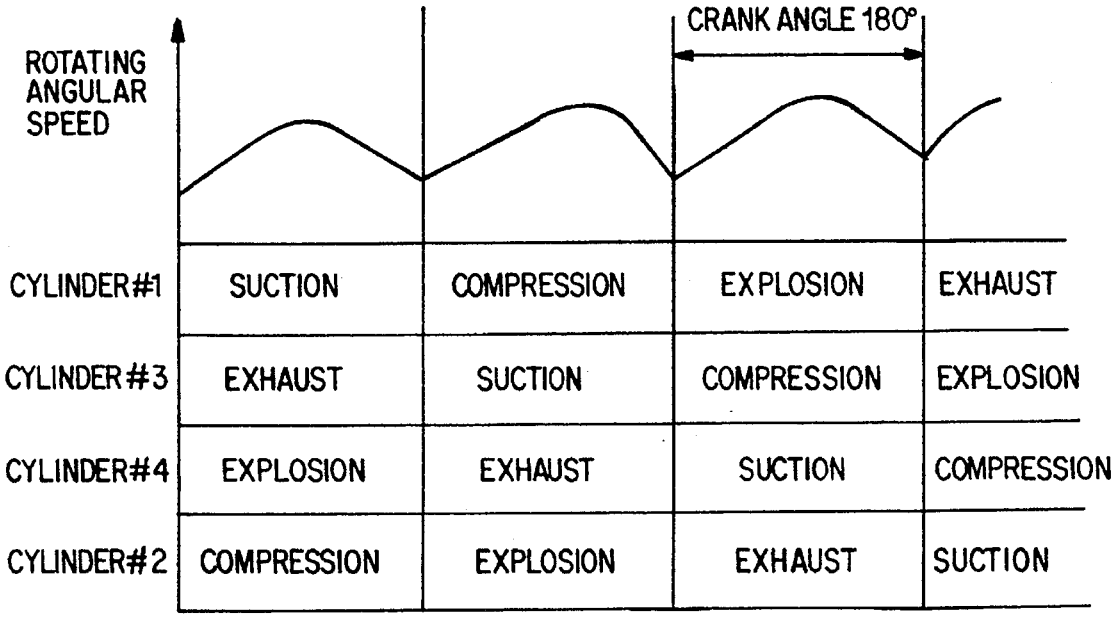
FIG. 5 is a characteristic graph showing the behavior of rotating angular speed of an engine.

As shown in FIG. 5, during operation at a lean air/fuel ratio the rotating angular speed of the crank is measured with sufficiently short intervals for each of the cycles of suction, compression, explosion and exhaust based on the output signals from the crank angle sensor 16*a* contained in the distributor 16 to measure the rotating angular speed in very small rotating angle increments. (The rotation of the crank shaft may be directly measured by detecting rotation at, for example, a ring gear part.) The rotating angular speed fluctuates during each of the cycles, due primarily to the explosion force in the explosion cycle in each of the cylinders. The combustion state in the engine can be known by analyzing the fluctuation of engine rotating angular speed. That is, by analyzing the fluctuation in the rotating angular speed for the explosion cycle of each of the cylinders, the combustion state it each of the cylinders of the engine can be obtained.

On the other hand, in a multi-cylinder engine, differences in the combustion states in each of the cylinders are often caused by the uneven distribution of sucked air, the deviation in the fuel injectors 13 and the deviation in the ignition plugs. Therewith, the deviation in the torque in each of cylinders occurs, and the torque fluctuation is increased, degrading the operability of engine. And the $NO_x$ exhausting concentration from a cylinder operated under a rich air/fuel condition is high, and causes degradation in exhaust performance.

Therefore, in order to avoid the disadvantages described above, it is effective to perform a correction control against a cylinder which has a combustion state different from those in the other cylinders, using the combustion state parameter (torque fluctuation or $NO_x$ exhaust concentration) for each of cylinders. In order to identify a cylinder having a different combustion state from the others and quantitatively understand the amount of the difference, it is necessary to determine the difference between the combustion state in each of the cylinders and the average state for all of the cylinders in the engine. This can be done by obtaining the average value of combustion state parameters for all of the cylinders, obtaining the differences between the average value and the combustion state parameter for each of the cylinders, and correcting the fuel supply rates depending on the magnitude of the difference. That is, the fuel supply rate is corrected toward a rich state when the combustion state is unstable, and toward a lean state when the combustion state is stable, depending on the amount of the difference from the average value.

When the average value of the combustion state parameters overall is larger or smaller than a desirable value after eliminating the deviation among each of the cylinders in the multi-cylinder engine using this method, it is effective to perform a correction for all cylinders, since the combustion state in all of the cylinders is not deemed to satisfy the demand.

Figure 1:
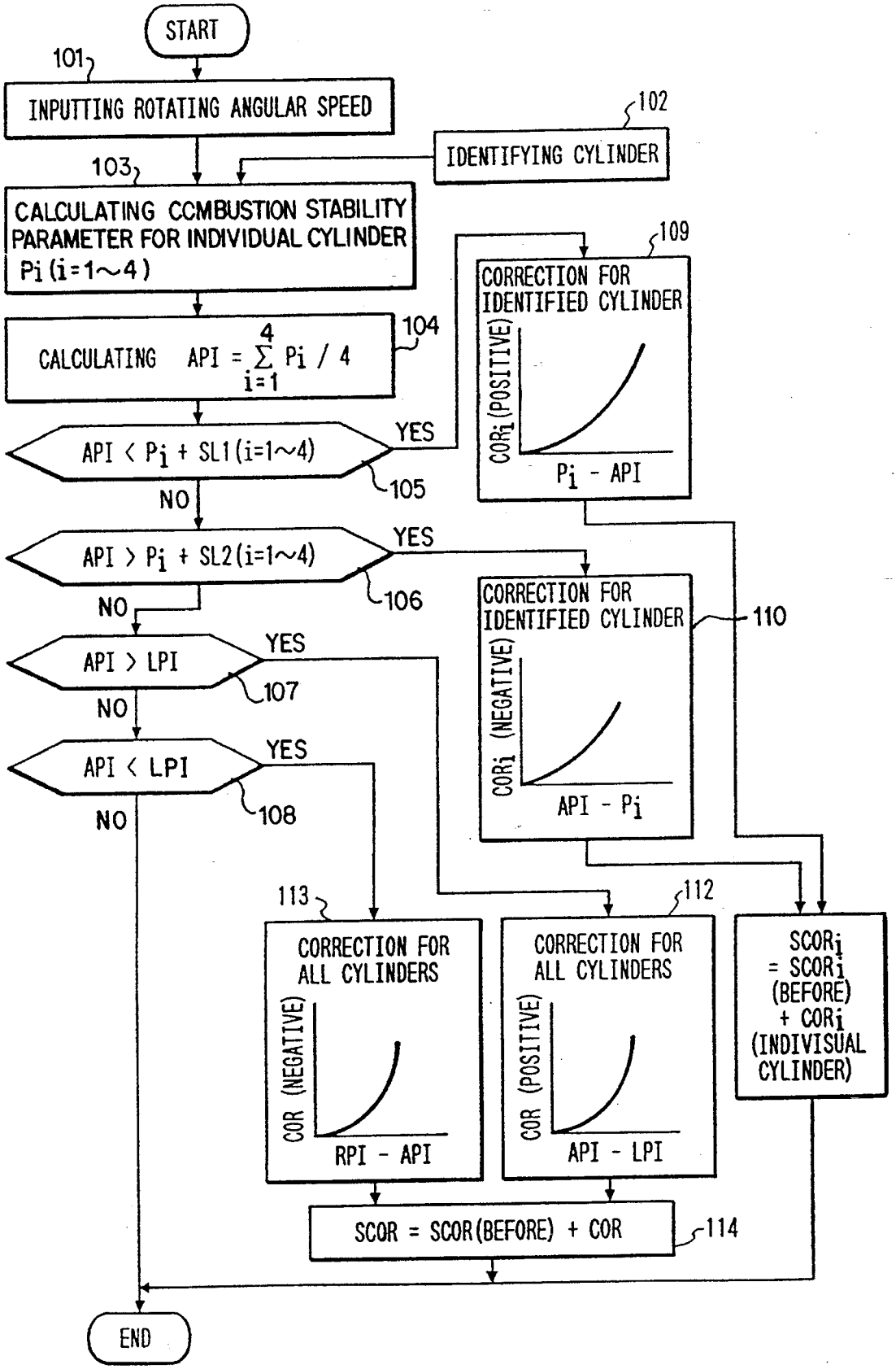
FIG. 1 is a flow-chart showing an embodiment of a control process performed by an engine controller according to the present invention.

In order to realize the control process described above, an example of a flow-chart for calculating process executed by the MPU 15*a* will be described, referring to FIG. 1. This example deals with a four cylinder engine.

The process comprises firstly inputting a rotating angular speed (measured at very small rotating angle increments) in step 101, identifying the explosion cylinder in step 102, and concurrently calculating the combustion stability parameter $P_i$ for the identified explosion cylinder in step 103. (In this example, the fluctuation in rotating angular speed is used.) Next, the process comprises summing the combustion stability parameters of each of the cylinders and calculating the average value API of all cylinders in step 104. Thereafter, it is determined whether or not the parameter $P_i$ (i=1 to 4) for each of the cylinders exceeds the average value API by a significant difference SL1 in step 105. If it does, it is judged that the combustion state in the cylinder is in a bad condition, and the processing goes to step 109 to calculate a correction value for shifting the fuel supply to a rich state so that the combustion state in the cylinder becomes equal to those of the other cylinders. If not, it is then determined whether the parameter $P_i$ (i=1 to 4) for each of the cylinders is less than average value API by a significant difference SL2 in step 106. If so, it is judged that the combustion state in the cylinder is in good condition, and the processing goes to step 110 to calculate a correction value for shifting the fuel supply to a lean state so that the combustion state in said cylinder becomes equal to those of the other cylinders. In this case, the correction value $COR_i$ (i=1 to 4) is determined depending on the magnitude of the difference between the average value API and the parameter $P_i$ (i=1 to 4) for the cylinder. The correction values $COR_i$ obtained above are added at each iteration of the judgment in step 111, the added value being stored in RAM 15*c* as an added value for correction values $SCOR_i$ (i=1 to 4) for each of the cylinders.

On the other hand, if not in both of the judgments above, that is, it is judged that the combustion states in all of the cylinders are substantially the same, the processing goes to step 107. When the average value API is larger than a given value LPI, that is, it is judged that the combustion states in all of the cylinders are in a bad condition, the processing goes to step 112 to calculate a correction value COR (positive) for shifting the fuel supply to a rich state to improve the combustion states in all of the cylinders. The correction value COR (for all of the cylinders) is determined in this case depending on the magnitude of the difference between the average value API and the given value LPI. When the average value API is smaller than the given value LPI, it is judged that the combustion states in all of the cylinders are in a good condition, and the processing goes to step 113 to calculate a correction value COR (negative) for shifting all of the cylinders to a lean state, depending on the magnitude of the difference between the average value API and the given value LPI. The correction values COR obtained above are stored in an RAM 15*c* as an added value of correction values SCOR for all of the cylinders, and are added at each iteration of the judgment in step 114.

The fuel supply rate is corrected based on the added value of correction values SCOR for all of the cylinders. The new fuel supply rate is obtained by adding or multiplying the old fuel supplying rate.

By repeating this control process, firstly the variation of combustion states as between cylinders (and hence, the torque fluctuation) are decreased, with the combustion states in all of the cylinders being set near a lean limit boundary having a low cost of fuel with compatibility in the requirements between the amount of $NO_x$ exhaust and the combustion stability.

Figure 6:
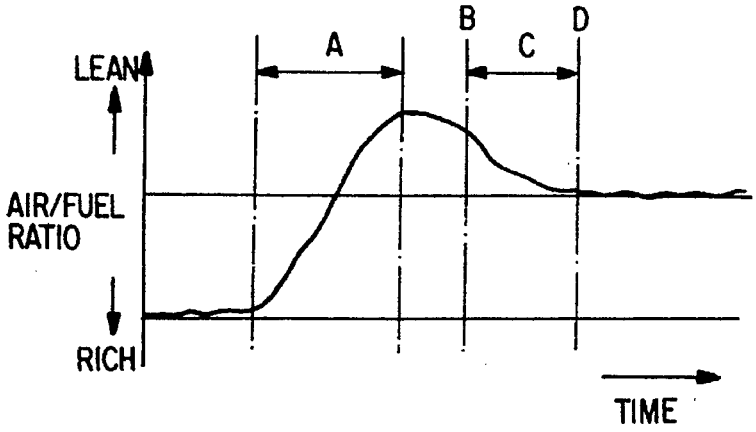
FIG. 6 is an example of experimental results showing the relationship between air/fuel ratio and torque fluctuation.
Figure 6A:
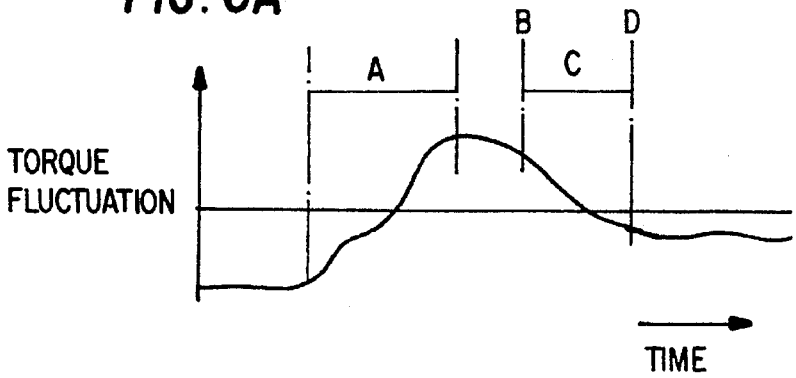
Figure 7:
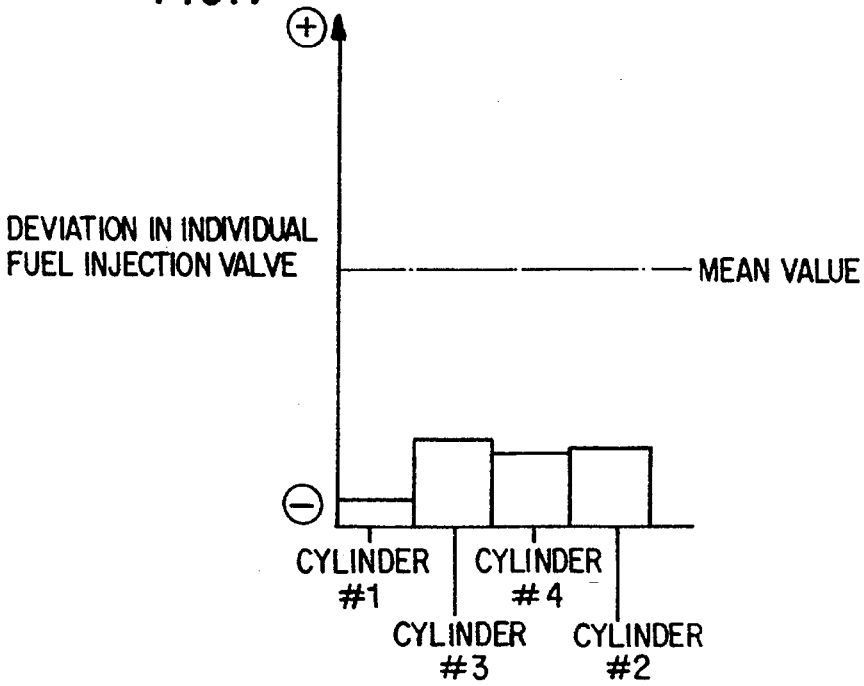
FIG. 7 is an example of experimental results showing a deviation characteristic due to individual fuel injection values.

FIG. 6 shows an experimental result obtained from the invention. When an engine is operated under a condition leaner than the theoretical stoichiometric air/fuel ratio, the operation parameters such as engine temperature rotating speed, load and so on must be properly adjusted. Thereafter, the fuel supply rate is decreased or the supplying air flow rate is increased so that the theoretical air/fuel ratio moves to a lean air/fuel ratio. Where there is no provision to obtain linearly the air/fuel ratio in the exhaust gas, the amount of increase or decrease is determined by a correction control using constant values depending on the operating conditions. Where means are provided to obtain linearly the air/fuel ratio in exhaust gas, the amount of increase or decrease can be linearly corrected with a closed loop using the signal. The region A in the figure indicates the correction control toward a target air/fuel ratio. In this experiment, since a deviation is intentionally introduced in the injectors 13 for each of the cylinders (#1 to #4), as shown in FIG. 7, the actual air/fuel ratio becomes leaner than the target air/fuel ratio, and the combustion stability degrades. The combustion stability in each of the cylinders is then detected and corrected with the process according to the flow-chart shown in FIG. 1. Even in the case where there is a provision to determine the air/fuel ratio in exhaust gas linearly, the same behavior may take place since the degradation in combustion occurs in some cases depending on the accuracy of the sensor.

Figure 8:
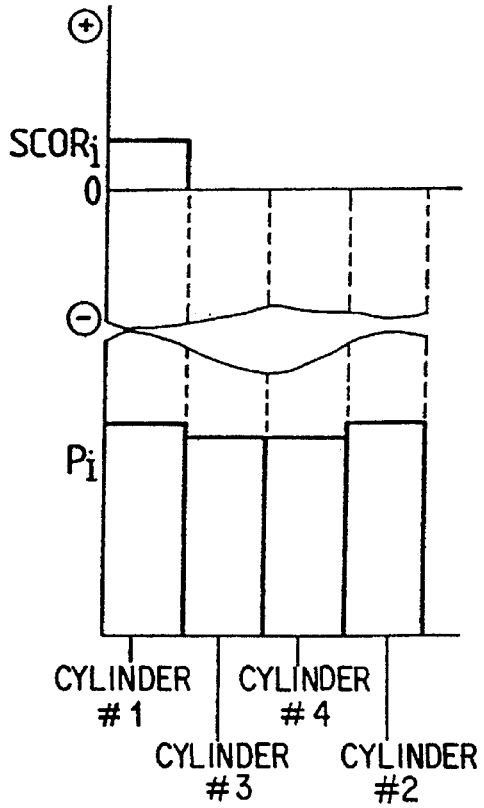
FIG. 8 is an example of experimental results showing the relationship between the fuel supply rate correction coefficients for each of the cylinders and combustion stability parameter.
Figure 9:
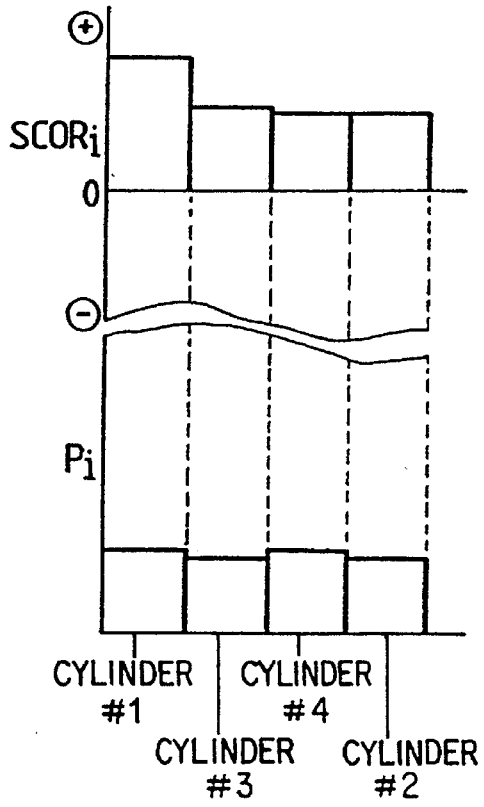
FIG. 9 is another example of experimental results showing the relationship between the fuel supply rate correction coefficients for each of the cylinders and a combustion stability parameter.

Although the speed of correction depends on the magnitude of the correction coefficient (amount) $COR_i$ and the frequency of the calculations, the correction converges rapidly when the magnitude of the correction coefficient $COR_i$ is made as large as possible within a region not to cause any error correction depending on the detecting time duration and the accuracy of the combustion stability parameter. The fuel supply rate correction coefficients (amount) $SCOR_i$ and the combustion stability parameters $P_i$ for each of the cylinders at the point B (FIG. 6) are shown in FIG. 8. The correction coefficient $SCOR_i$ for the first cylinder is in richer state, therefore, it is understood that the deviation of this cylinder (as shown in FIG. 7) is accurately detected and corrected. With this correction, the average air/fuel ratio shifts toward richer region. In the region indicated by C in FIG. 6, the air/fuel ratio correction for all cylinders is performed, and the average air/fuel ratio is shifted toward richer region. The fuel supplying rate correction coefficients $SCOR_i$ and the combustion stability parameters $P_i$ at the point D (FIG. 6) are shown in FIG. 9. Coefficients toward rich are stored for all of the cylinders, and with these coefficients, the combustion stability is improved. As a result, the air/fuel ratio near the limit boundary can be obtained while maintaining the combustion stability.

Figure 10:
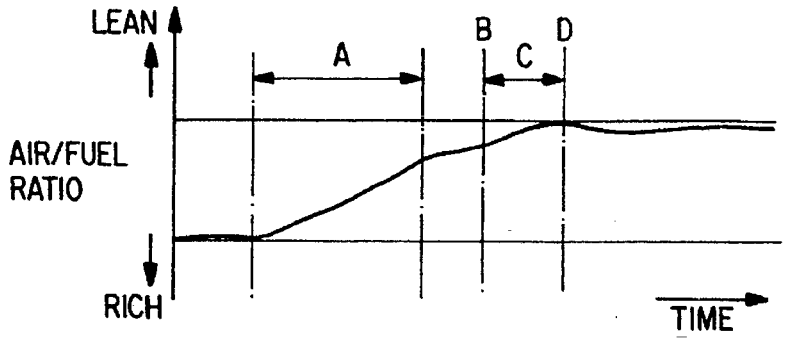
FIG. 10 is another example of experimental results showing the relationship between the air/fuel ratio and torque fluctuation.
Figure 10A:
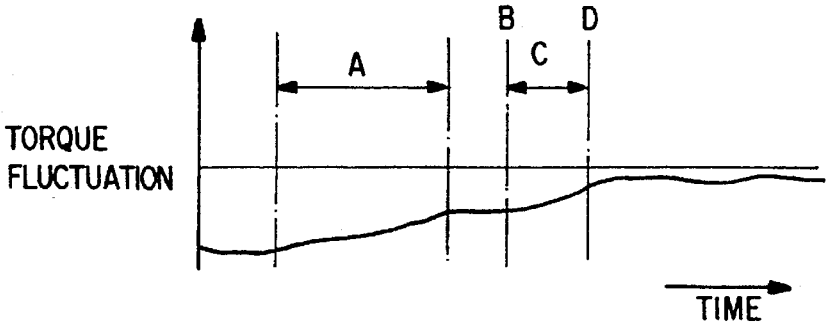
Figure 11:
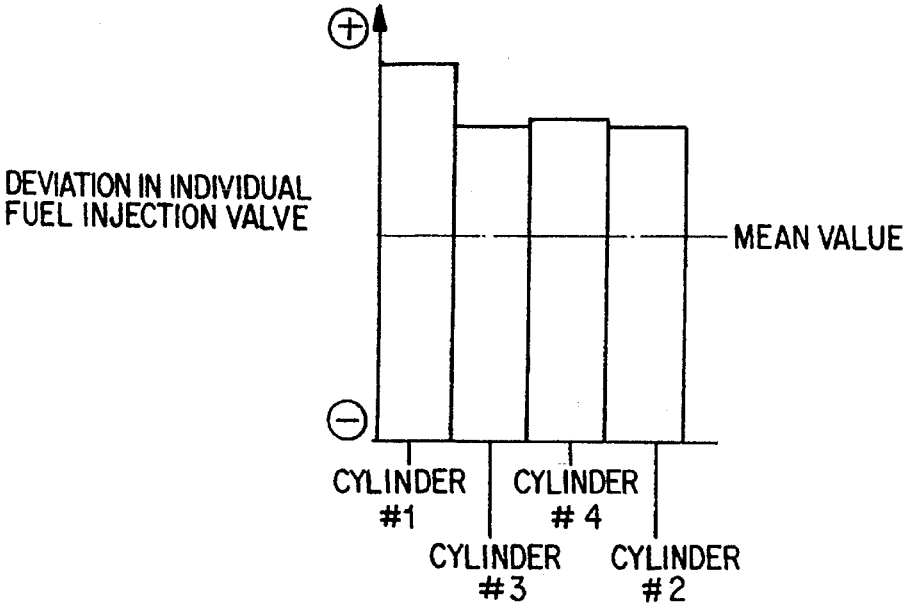
FIG. 11 is another example of experimental results showing a deviation characteristic due to individual fuel injection valves.
Figure 12:
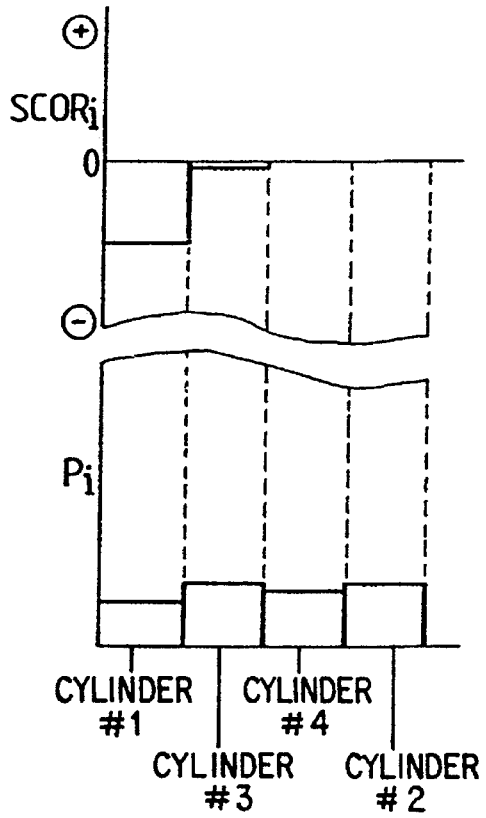
FIG. 12 is another example of experimental results showing the relationship between the fuel supply rate correction coefficients for each of the cylinders and a combustion stability parameter.
Figure 13:
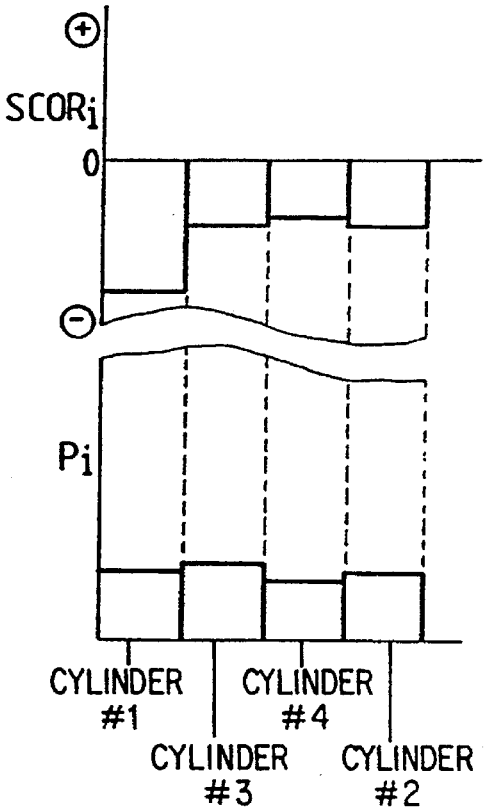
FIG. 13 is still another example of experimental results showing the relationship between the fuel supply rate correction coefficients for each of the cylinders and a combustion stability parameter.

The above description is an example of a control at a time when the air/fuel ratio is extremely lean. FIG. 10 shows an example where the air/fuel ratio is rich. The region A in the figure indicates the correction control toward a target air/fuel ratio. Since the deviation in the injectors 13 for each of the cylinders (#1 to #4) is, as shown in FIG. 11, intentionally introduced, the air/fuel ratio is rich. Therefore, the cylinder having an extreme combustion state is detected and corrected with the process according to the flow-chart Shown in FIG. 1. The resulting fuel supply rate correction coefficients (amount) $SCOR_i$ and the combustion stability parameters $P_i$ for each of the cylinders at the point B are shown in FIG. 12. Similar to the experiment described above, it is understood that the deviation of the cylinder is corrected. In the region indicated by C in FIG. 10, the air/fuel ratio correction for all cylinders is performed. This correction is completed at the point D in FIG. 10. The fuel supplying rate correction coefficients $SCOR_i$ and the combustion stability parameters $P_i$ at the point D in FIG. 10 are shown in FIG. 13. Coefficients toward lean are stored for all of the cylinders, and with these coefficients, the combustion stability is brought near the stability limit. As a result, the air/fuel ratio near the limit boundary can be obtained while keeping the combustion stability.

Figure 14:
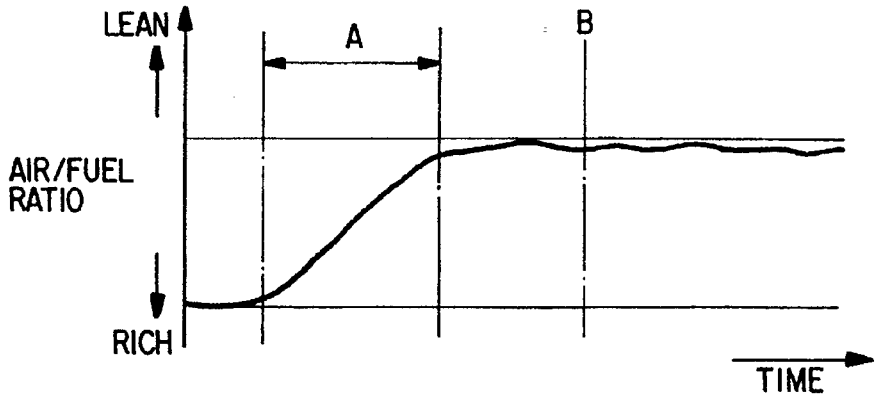
FIG. 14 is still another example of experimental results showing the relationship between air/fuel ratio and torque fluctuation.
Figure 14A:
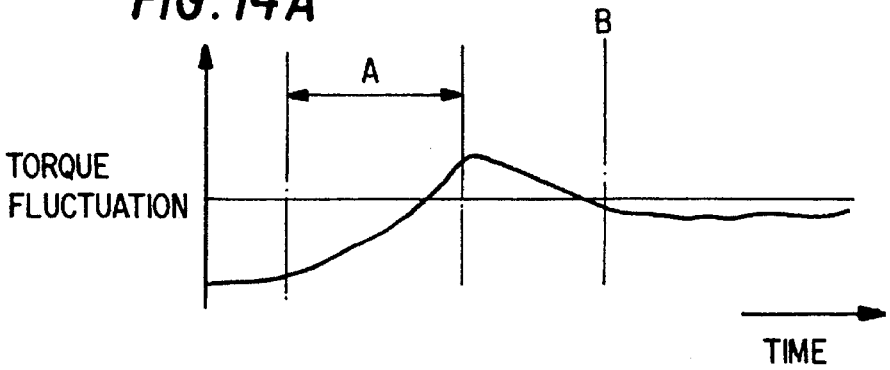
Figure 15:
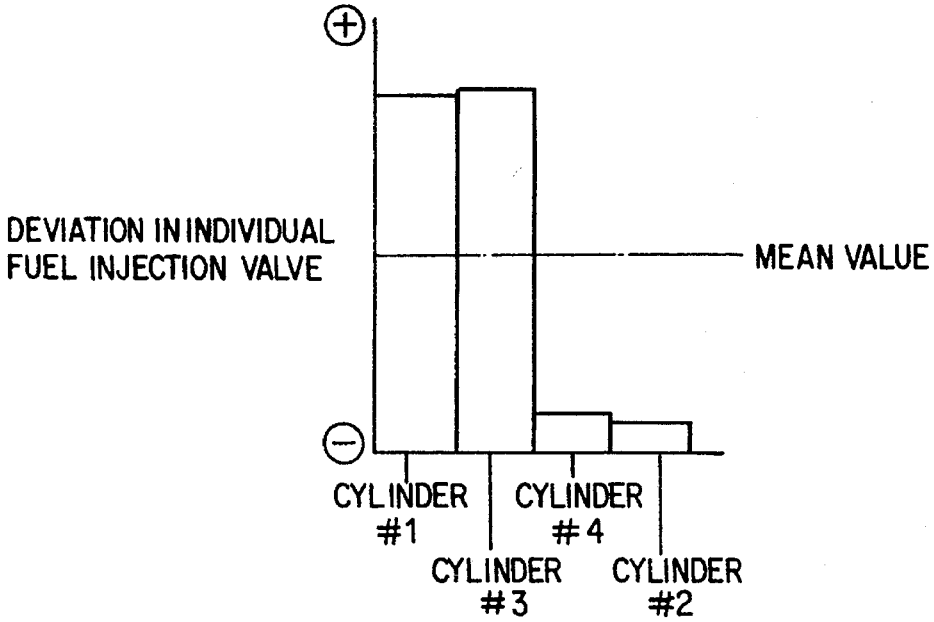
FIG. 15 is still another example of experimental results showing a deviation characteristic due to individual fuel injection valves.
Figures 16, 18:
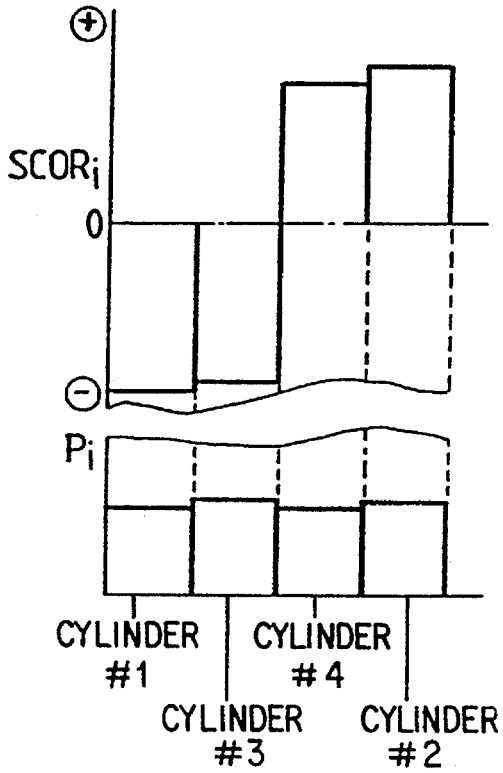
FIG. 16 is still another example of experimental results showing the relationship between fuel supplying rate correction coefficients for each of the cylinders and combustion stability parameter.
FIG. 18 is a chart showing another embodiment of the fuel supply rate correction coefficients.

FIG. 14 shows another example of the control process according to the invention where the air/fuel ratios in each of the cylinders (#1 to #4) deviate, that is, some are rich and the others are lean. The deviation of the injectors 13 for each of the cylinders, as shown in FIG. 15, is intentionally introduced. In the region A in FIG. 14 the correction control is performed toward a target air/fuel ratio. Since the air/fuel ratios in two cylinders are rich and the air/fuel ratios in other two cylinders are lean, the average air/fuel ratio is approximately equal to the target air/fuel ratio. However, some of the air/fuel ratios are rich and the others are lean, and the torque fluctuation exceeds the allowable limit. Therefore, the combustion stabilities of each of the cylinders are detected and corrected with the process according to the flow-chart shown in FIG. 1. The correction is completed at the point B in FIG. 14, and the torque fluctuation is brought within the allowable limit. The fuel supply rate correction coefficients $SCOR_i$ and the combustion stability parameters $P_i$ for each of the cylinders at the point B are shown in FIG. 16. It can be understood that the fuel supplying rate correction coefficients $SCOR_i$ corresponding to the deviations of each of the cylinders are stored. As a result, the air/fuel ratio near the limit boundary can be obtained, while keeping the combustion stability.

Figure 17:
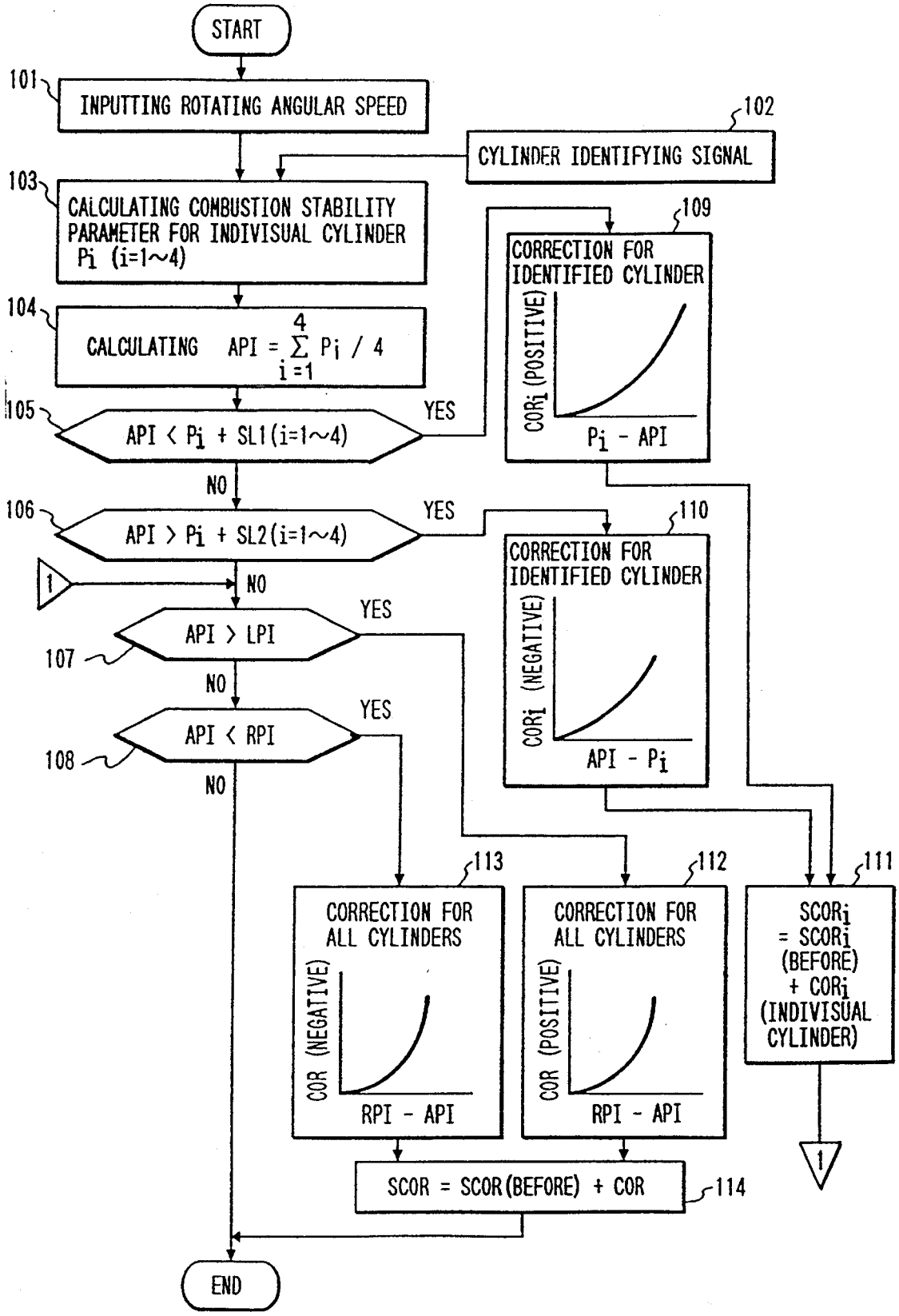
FIG. 17 is a flow-chart showing another embodiment of a control process performed by an engine controller according to the present invention.

Although in the experiments described above the correction for all cylinders is performed after the correction for each of the cylinders is completed, both of the corrections may be performed practically concurrently, as shown in FIG. 17. The correction for each of the cylinders and the correction for all cylinders are performed in a process in series. The process steps in FIG. 17 having the same notation as in FIG. 1 perform the same functions.

In the embodiment shown in FIG. 17, after completion of step 111, the processing goes back to step 107 to execute the following processes. In this embodiment, the correction gain needs to be selected small so as not to overcorrect when the correction gain for each of the cylinders and the correction gain for all cylinders are combined.

In the embodiments described above, each cylinder has only one correction coefficient $SCOR_i$ for the fuel supply rate. However, when the engine operating condition changes, the detecting errors in the air flow rate and fuel supply rate change. Therefore, if each cylinder has the correction coefficients $SCOR_i$ depending on the operating conditions, the control accuracy can be improved even further. For this purpose, FIG. 18 shows a domain (look up table) of the engine speed versus engine load in which each of the correction coefficients $SCOR_i$ for each cylinder are provided in each region of the operation conditions. Although the operating condition is divided into 16 (sixteen) regions in this embodiment, the number of regions may be varied depending on the requirement in the correction accuracy. Instead of defining the operation region with two parameters, it may be possible to employ a table having one parameter such as engine speed, engine load, suction air flow rate of which each of the regions has the correction coefficient $SCOR_i$.

Further, by storing the correction coefficients $SCOR_i$ for fuel supply rate in a non-volatile memory (for example, ROM 15*b*), a target air/fuel ratio can be attained in a short time since it is possible to store the values of eliminated deviations. On the other hand, in some cases, the air/fuel ratio at the limit of the combustion stability varies with environmental conditions, such as intake air temperature. In such a condition, when a non-volatile memory is employed to store the correction coefficients $SCOR_i$, it takes a long time to achieve the limit of combustion stability. Therefore, by taking the balance of both conditions into consideration, it might be decided whether or not a non-volatile memory is employed.

To cope with misjudgment of combustion stability, it is preferable to restrict the maximum and minimum values of the correction coefficients by proper limits. In this case, judgment on whether or not the correction coefficient is restricted within the limit value may be executed in the step following to step 111 or 114.

Although in the foregoing description, calculation of the combustion stability parameters is based on the rotating angular speed of the engine, the same effect can be obtained by using the other parameters such as combustion pressure in cylinder or vibration of cylinder block. Moreover, although in the above description torque control is performed by controlling the fuel supply rate, intake air flow rate or ignition timing may also be used for this purpose.

Where means are provided for detecting exhaust air/fuel ratio linearly, it is also effective to eliminate deviation in the output from the exhaust air/fuel ratio detector by using the air/fuel ratio under the desirable combustion state obtained by the present application.

According to the control method and apparatus described above, the variation in the combustion state in each of the cylinders of an engine can be detected and corrected, the average combustion state for all cylinders can be brought to a required state, and a decrease in $NO_x$ and stabilization of the combustion can be realized.

Figure 21:
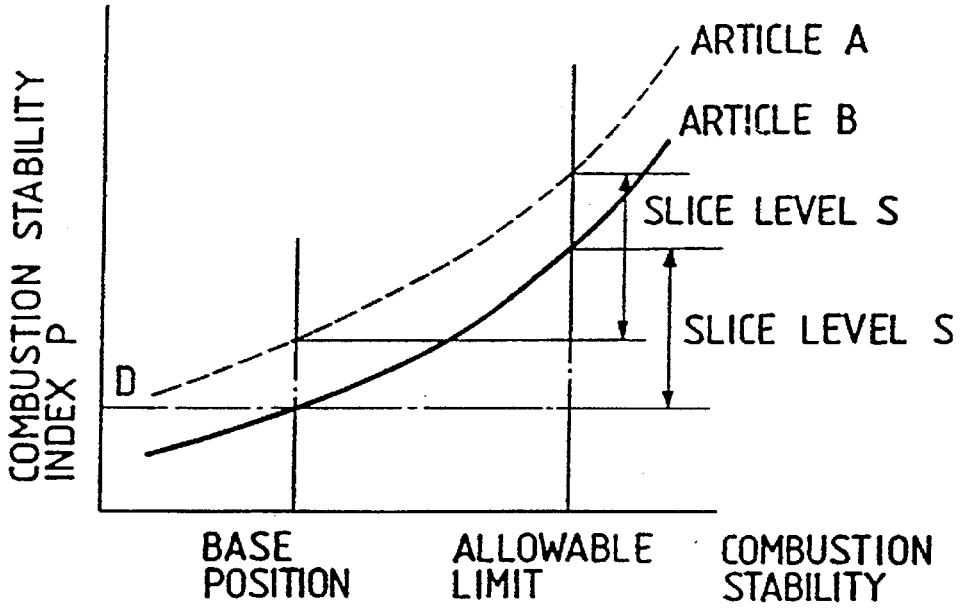
FIG. 21 is a characteristic diagram of a combustion stability index.

The engine control described above assumes that the various detectors, including the rotating angular speed detector are accurate. However, various sensors and signal processors have individual differences and detecting errors. For example, the rotation detector described above outputs a rotating information signal having an error relative to actual crank shaft rotation, due to tolerances or variations in the individual detector units, and in the transmission path of rotation. Therefore, the combustion stability index P calculated based on the rotating information has a relationship with the actual combustion stability as shown in FIG. 21, depending on individual tolerances. The magnitude of the deviation of the combustion stability index P due to the error in the rotating information depends only on the individual variations since the error is always constant regardless of the combustion stability. As the result, the relationships of combustion stability versus combustion stability index in different individual units have, as shown in FIG. 21, a parallel shift relation and the same gradient as each other. Therefore, an operating state where the combustion stability is constant and stable is employed as a base position, and the combustion stability index P at the base position is used to judge degradation in combustion, which leads to a correct judging result. In other words, as shown in FIG. 21, the combustion stability index P at the base position is stored as a learned value D for judging degradation in combustion. Judgment of the degradation in combustion is then performed by comparing the combustion stability index P the learned value D plus slice level S (FIG. 21), which realizes a correct judgment. In this manner, the deviation in the individual relationship between the combustion stability and the combustion stability index P can be corrected and the actual degradation in combustion can be accurately judged. Correction is performed based on the result of the judgment; for example, in case of degradation in combustion due to lean burn, the correction is performed toward rich operation when the combustion stability is unstable and toward lean operation when the combustion stability is stable. Therewith, a desirable combustion state can be obtained.

Figure 19:
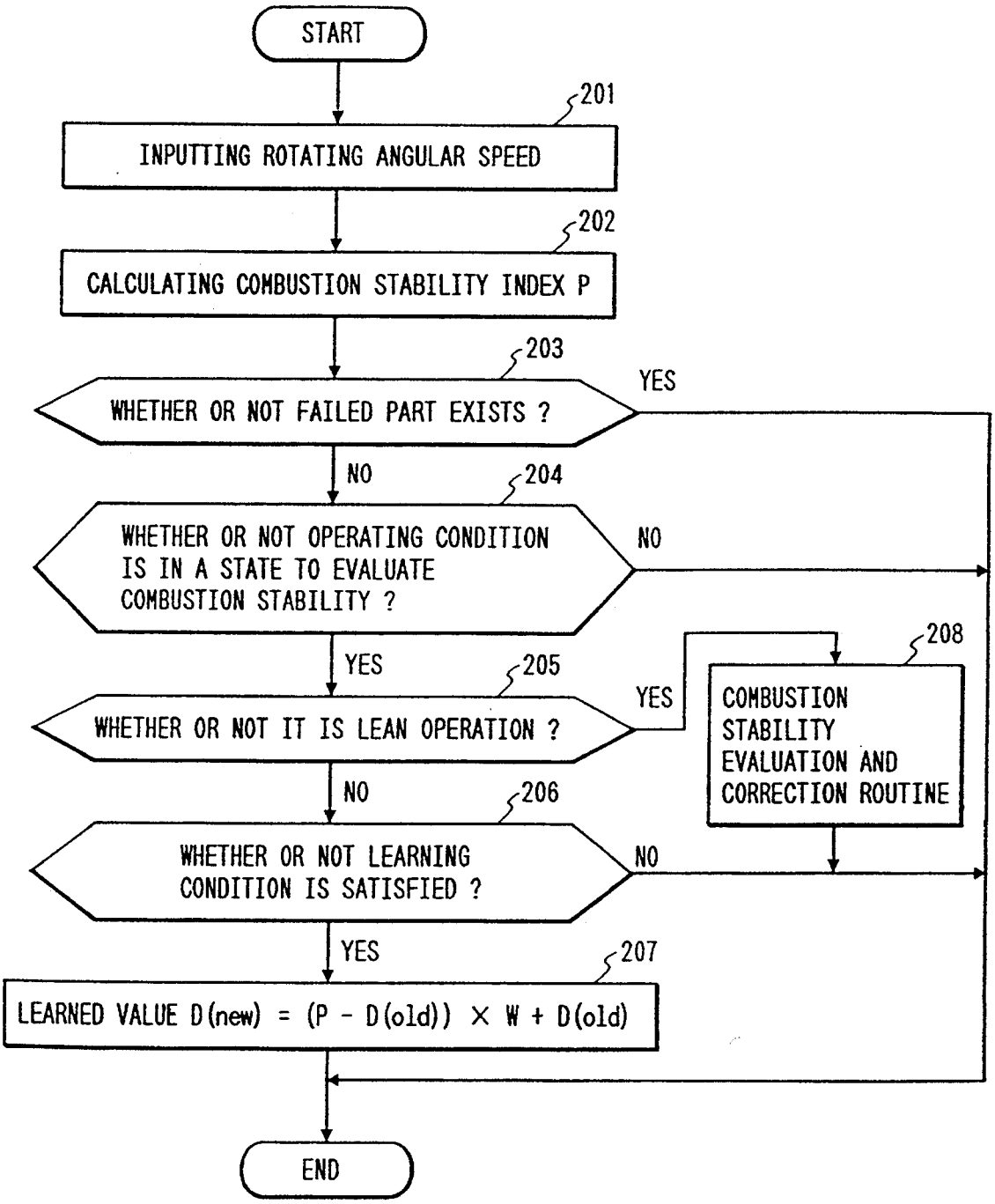
FIG. 19 is a flow-chart showing a further embodiment of a control process executed by an engine controller according to the present invention.

An example of a calculating process executed with the MPU 15 to realize such a control is shown in the flow-chart of FIG. 19. In this embodiment, the combustion stability index P is calculated from the rotating angular speed in steps 201 and 202.

When there is any failure in an engine part, the combustion stability control cannot be realized. Therefore, failure information is confirmed in step 203. If there is any failure, the processing is ended. Next, the operating condition of the engine is judged in step 204, and the processing is also ended if the combustion stability cannot be correctly evaluated. The following can be thought as the judging data for the judgment; engine rotating speed, engine water temperature, vehicle speed, engine load, starter motor operating signal, throttle valve opening, transmission stage position and so on.

Thereafter, in step 205 it is determined whether it is in a lean operation. If so, the combustion stability evaluation is executed in step 208, which will be described later. If it is not in a lean operation, the processing goes to step 206, and in order to obtain the learned value D for judging degradation in the combustion stability, a determination is made whether a learning condition is satisfied. The learning of the learned value D needs to perform under an operating region where the operating condition of the engine is stabilized and an accurate and constant combustion stability can be obtained. Therefore, it is determined whether the operating condition is in that region. That is, although the judgment is performed using the judging data described in step 204, the condition of the judgment is different from that in step 204. There is a particular operating condition which exhibits a constant combustion stability, for example, a non-load operating condition such as an engine idling operation within a certain condition of rotating speed and load, or a fuel cut-off condition where the combustion stability is zero since combustion does not exist in the engine. By learning the combustion stability index P during that condition, the deviation due to individual differences can be accurately eliminated. It is preferable to add a judging condition with timing to the judgment for the purpose of stabilizing condition.

Next, the learned value D is updated in step 207. In this embodiment, the difference between a combustion stability index P at that time and a learned value D having been stored previously is multiplied with a weight W, and the result is added to the learned value D having been stored previously. By repeating this process, the learned value D becomes equal to the combustion stability index P in the operating condition judged in step 206, and the convergence in learning is completed. The weight W is varied depending on the magnitude of the difference between the combustion stability index P and the learned value D to accelerate the convergence and prevent divergence.

Since the convergence in learning in step 207 is a base for judging the degradation in combustion during a lean operation, prohibiting lean operation until completion of the convergence in learning is effective for preventing the combustion from degradation. Practically, the following means can be considered; number of learning completions is counted in step 207, the lean operation being prohibited until the number reaches to a given number, or the lean operation being prohibited until the difference between the combustion stability index D and the learned value P enters within a given value.

By storing the learned value D in the ROM **15*b*** which is a non-volatile memory, the result of the convergence once obtained can be utilized thereafter to decease the frequency of prohibitions of lean operation.

Although one combustion stability index P is used as a parameter in the process described above, in a case of a multi-cylinder engine, it is possible to perform a more detailed control by calculating the combustion stability index P for each of the cylinders and performing the processing described above for each of the cylinders.

Figure 20:
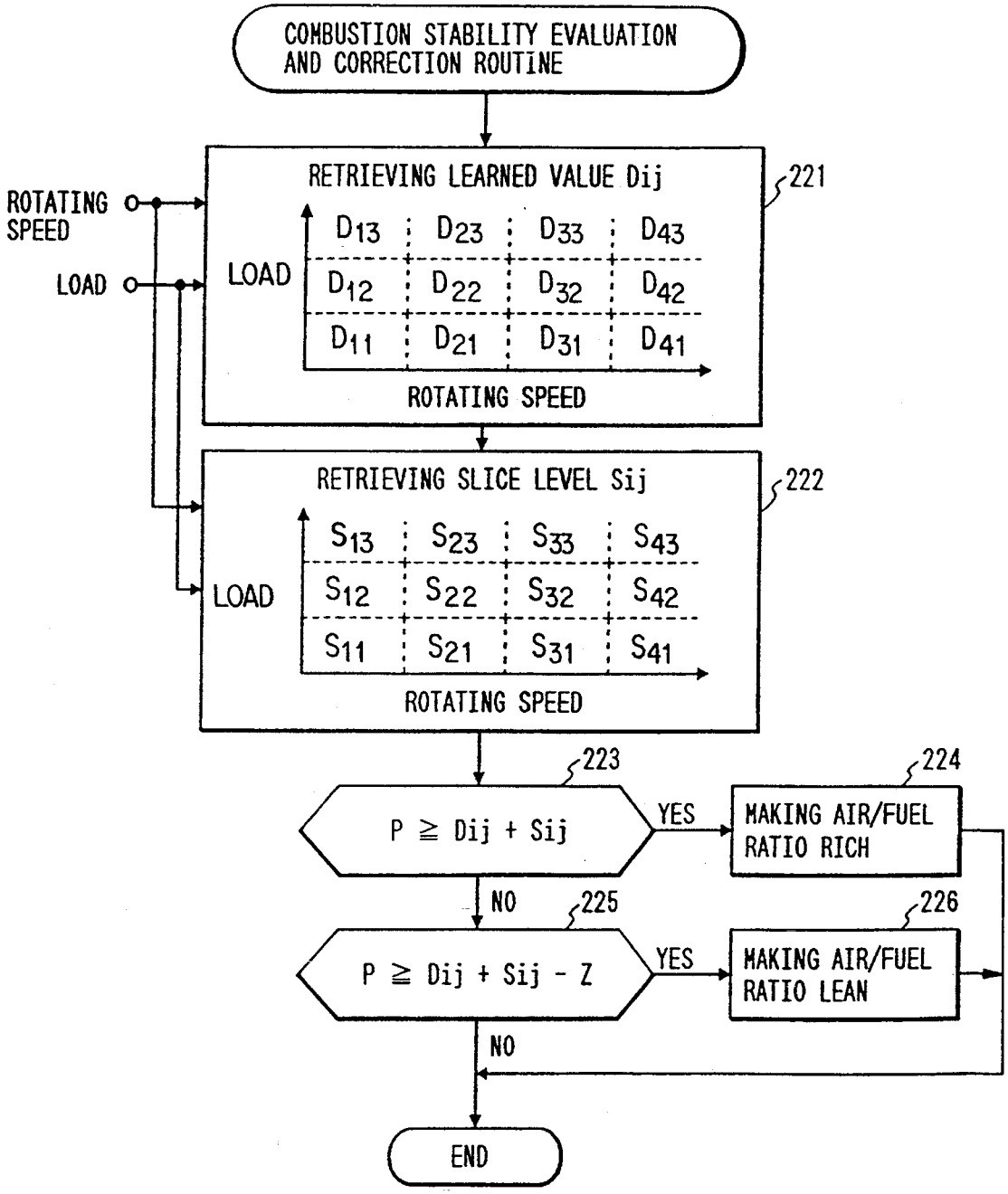
FIG. 20 is a flow-chart of a combustion stability evaluation process.

The combustion stability evaluation and correction routine in step 20B of FIG. 19 are shown in detail in FIG. 20. In step 221, a learned value D for a comparing base is retrieved based on the rotating speed and the load information under the operating condition. In this embodiment, values of D in the combustion stability shown in FIG. 19 are learned for every operating region, such as $D_{11}$, $D_{12}$, . . . shown in step 221. This means that when the combustion stability is different depending on the operating region the operating region must be discriminated as combustion stability values are learned. Therefore, the operating region is divided into small areas by engine rotating speed and load state, and each of the learned values D is independently provided for each region. The operating region is defined by rotating speed and load in this example in which the combustion stability for each area can be accurately determined by using these parameters. In a case where there are other effective parameters to specify the combustion stability, such as engine water temperature, throttle valve opening and so on other than the above parameters, those values may be used for retrieving the learned value D.

Next, in step 222, slice level S used for evaluating the combustion stability under the operating state is retrieved. This process deals with the existence of variations in margins (slice levels $S_{11}$, $S_{12}$, . . . ) up to the allowable upper limits for the combustion stability, since the combustion stability used as a base differs depending on the operating states. The combustion stability index P is compared in step 223 and in step 225 with the learned value D and the slice level S retrieved in steps 221 and 222. In step 223, if the combustion stability index P is larger than the sum of the learned value D and the slice level S, it is concluded that the combustion stability is worse than the allowable value. If the difference is large, processing, for richer operation is performed in step 224 since the air/fuel ratio is leaner than the desirable one. On the other hand, in step 225 it is determined whether the combustion stability is better than the allowable value and exceeds the rich side limit in the lean air/fuel ratio operating region. If so, processing for lean operation is performed in step 226 since the air/fuel ratio is rich. In step 225 a given value Z is subtracted from the sum of the learned value D and the slice level S, and the result is used as the judging base, since it is necessary to obtain the combustion stability under when the aims/fuel ratio is less than the allowable upper limit for $NO_x$ concentration.

By repeating this process, the air/fuel ratio can be controlled to fall within the lean air/fuel ratio operating region.

In the embodiment shown in FIG. 20, it is required that the learned values D are well learned in the operating state where the combustion stability is evaluated. Therefore, a method to estimate the learned values D in the region where learning is not sufficiently progressed is required in order to evaluate the combustion stability in such a region. This method will be described below, referring to FIG. 22.

Figure 22:
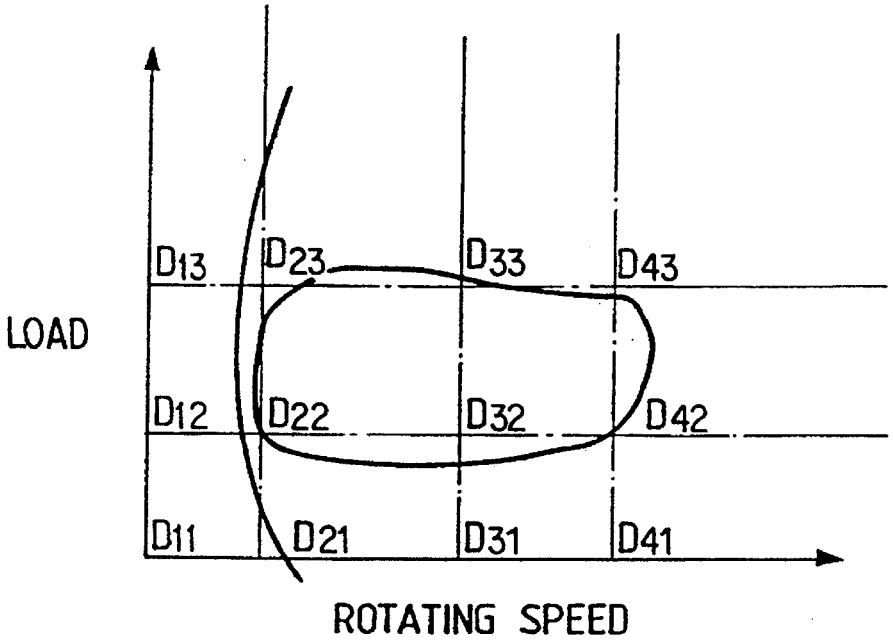
FIG. 22 is a characteristic diagram showing the relationship between operating region and combustion stability.

FIG. 22 is an example showing each of the learned values provided over the operating region and the distribution of the combustion stability in each of the operating states. In this example, $D_{22}$ and $D_{32}$ have a nearly identical combustion stability. Therefore, when a reliable learned value is obtained in one of the two regions and the same learned value can be applied to the other region, and the combustion stability can thus be evaluated in the two regions. Further, in a case where the relative differences among the operating regions are known in advance, the learned values can be estimated over the operating regions when learning is sufficiently progressed in a particular operating region.

Figure 23:
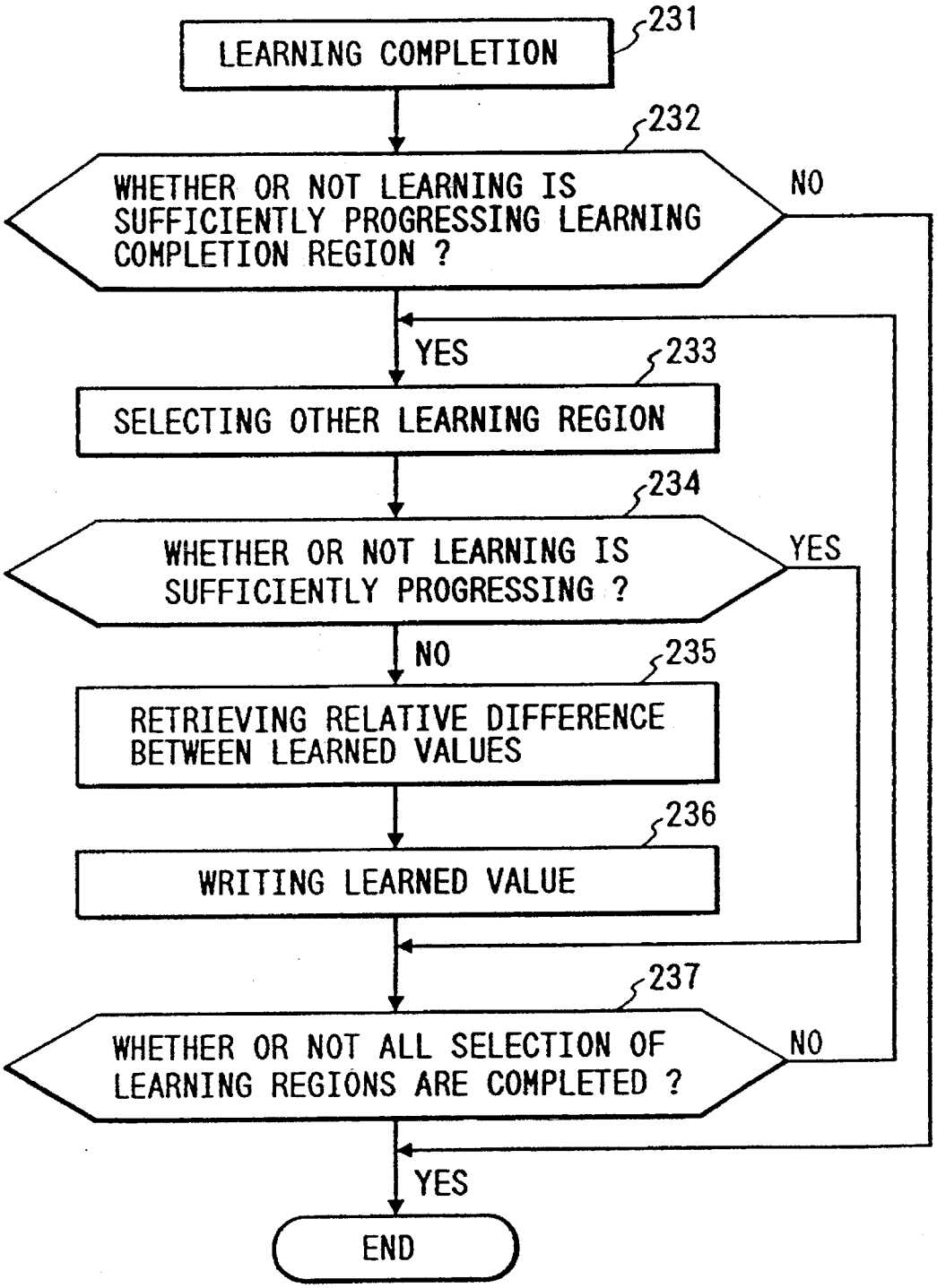
FIG. 23 is a flow-chart of a learning process executed by an engine controller according to the present invention.

A practical learning process will be described below, referring to the flow-chart shown in FIG. 23. The starting condition of this process is that learning in any one of the learning regions is completed, which is determined in step 231. Next, in step 232 judgment is made whether the learning has progressed sufficiently, based on the learning up to that time. Practically, it is considered that learning is sufficiently progressed when number of learning completions exceeds a preset value, or the difference between the combustion stability index P and the learned value D is within a preset value. When learning has not sufficiently progressed, it ms impossible to estimate the learned values in the other regions, and processing is ended When learning has adequately progressed the processing goes to step 233, where a region other than the regions where learning is completed is selected, and in step 234 the status of learning in the subject region is judged. If the learning has sufficiently progressed, the processing goes to step 237 since there is no need to estimate the learned value in the subject region. If the learning is not sufficiently progressed, the processing goes to step 235, and the relative difference between the learned values in the region where learning is completed (step 231) and in the subject region, is retrieved. In step 236, the learned value in the subject region is estimated by combining the relative difference obtained in step 235 and the learned value obtained in step 231. Next, in step 237, judgment is made whether the above processes are completed all over the learning regions. If not, the processes following to step 233 are repeated. In this manner, reliable learned values can be obtained in the regions where learning is not sufficiently progressed, and judgment on the combustion stability can be performed in broader operating regions.

Figure 24:
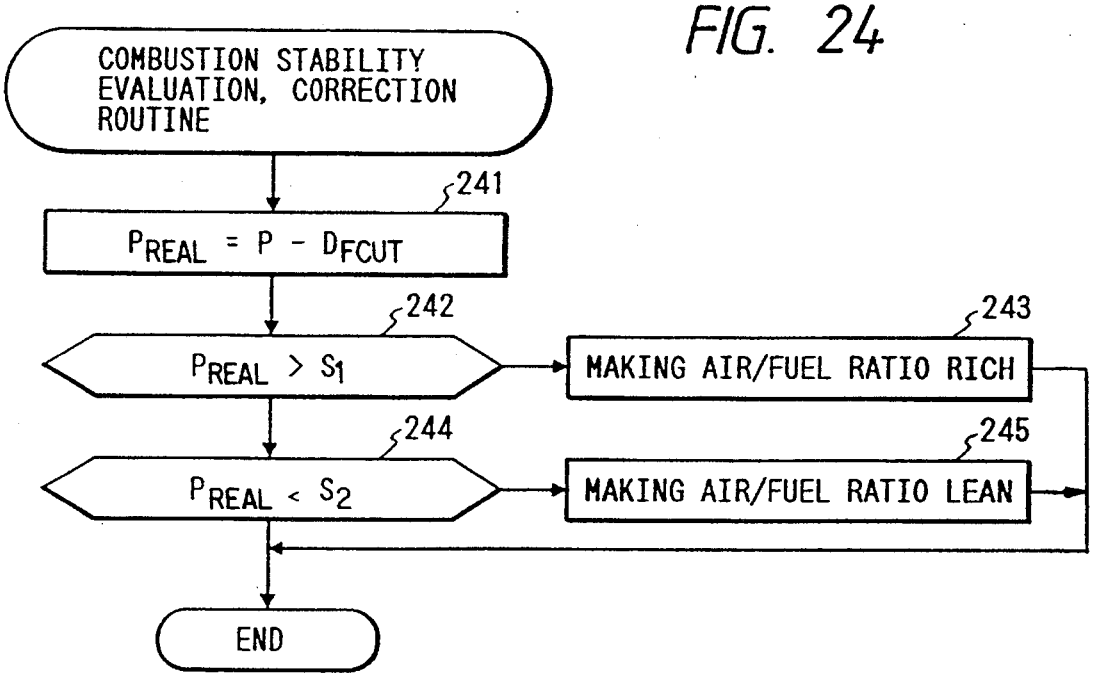
FIG. 24 is a flow-chart showing an embodiment of a combustion stability evaluation and correction process executed by an engine controller according to the present invention.

An example of the combustion stability evaluation and correction routine where learning of the learned value D is performed during fuel cut-off is shown in FIG. 24. In this case there is only one value of $D_{FCUT}$ since the operating state is to be learned during only one state; that is, during fuel cut-off. Since the learned value $D_{FCUT}$ is the combustion stability index when the combustion stability is zero, the learned value constitutes the off-set value in each of the combustion stability indexes P. Therefore, each of the off-set values is eliminated by subtracting the learned value $D_{FCUT}$ from the combustion stability index P, so that the resultant value can be used for judgment on the combustion stability. Thus, in step 241, the learned value $D_{FCUT}$ is subtracted from the combustion stability P, and the resultant value is designated as a combustion stability $P_{REAL}$. In step 242, $P_{REAL}$ is compared with the slice level $S_1$ at the upper limit of combustion stability. If the combustion stability $P_{REAL}$ exceeds the upper limit, the processing goes to step 243 and the air/fuel ratio toward rich operation is shifted so that the combustion stability enters within the allowable value. In step 244, the combustion stability $P_{REAL}$ is compared with the slice level $S_2$ at lower limit of the combustion stability. If the combustion stability $P_{REAL}$ is lower than the slice level $S_2$, the processing goes to step 245 and the air/fuel ratio toward lean operation is shifted so that the combustion stability enters within the given value.

The basic principle of a series of the processes in this embodiment is the same principle in the embodiment shown in FIG. 20, and by repeating the processes the combustion stability can be shifted to within a desirable region. In a case where the learning state for the learned value D is limited to only one region such as idling state, the processes are the same as described above.

In the method of the above embodiment the combustion stability index is learned individually. The method of correcting the input information from a sensor for calculating the combustion stability will be described below, taking a case evaluating the combustion stability by engine speed as an example.

Engine rotating angular speed fluctuates with the cycles in each of the cylinders as shown in FIG. 5. It has been described that the combustion state of an engine can be understood by analyzing the fluctuation of the engine rotational speed, since such fluctuation is caused mainly by the explosion in explosion cycle in each of the cylinders. Therefore, calculation of the combustion stability index is performed through measuring the rotating angular speed in a sufficiently short time against the cycle of the engine. Practically, a sensor having markings spaced at angular intervals to be measured is provided on a distributor linked with a crank shaft or a cam shaft representing the engine rotation, and the displacement of rotating shaft can be detected by the output signals from a detector for detecting passing of the markings. The rotation angular speed is obtained by measuring the time required for rotating between two or more markings. Since it is impossible to place the makings without any error, however, the measurement of the rotating angular speed also has errors, the magnitude of which depends on the individual units. Further, there is another error caused irregularly by back-rush existing in the rotating system.

Figure 25:
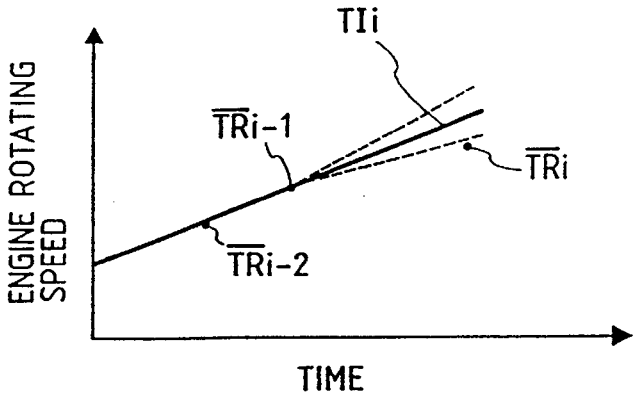
FIG. 25 is an example of experimental results showing an engine rotating speed detecting characteristic.

FIG. 25 shows an example of engine rotating speed measured in such a measuring system. The abscissa indicates time, and $\overline{TR}_{i-2}$, $\overline{TR}_{i-1}$, $\overline{TR}_i$ are average values of corrected rotating required times measured at corresponding times, but are converted and shown in engine rotating speed. Since they are the average values, errors irregularly generated are eliminated. Since the time interval to calculate the average values is short a change in the angular acceleration during that time interval is limited to a certain range. Therefore, the inclination between the average requiring times $TR_{i-2}$ and $TR_{i-1}$, that is, the angular acceleration, is kept nearly the same at the average requiring times $TR_{i-1}$, $TR_i$. The above will be explained below, referring to the figure. There is a predicted value $TI_i$ of the average requiring time $TR_i$ on the extension line of the inclination between the average requiring times $TR_{1-2}$ and $TR_{i-1}$. The average requiring time $TR_i$ falls within the range with a center of the predicted value $TI_i$ indicted by dotted lines when there is no error. The inclinations of the dotted lines indicate the angular accelerations corresponding to maximum and minimum possible changes between the average requiring times $TR_{i-1}$ respectively. Therefore, when the average requiring time $TR_i$ falls outside the range indicated by the dotted lines as shown in the figure, it can be said that the measurement for the average requiring time $TR_i$ includes an error due to individual differences. Since the magnitude of the error can be estimated from the magnitude of deviation from the dotted line range, the correction coefficient can be learned.

Figure 26:
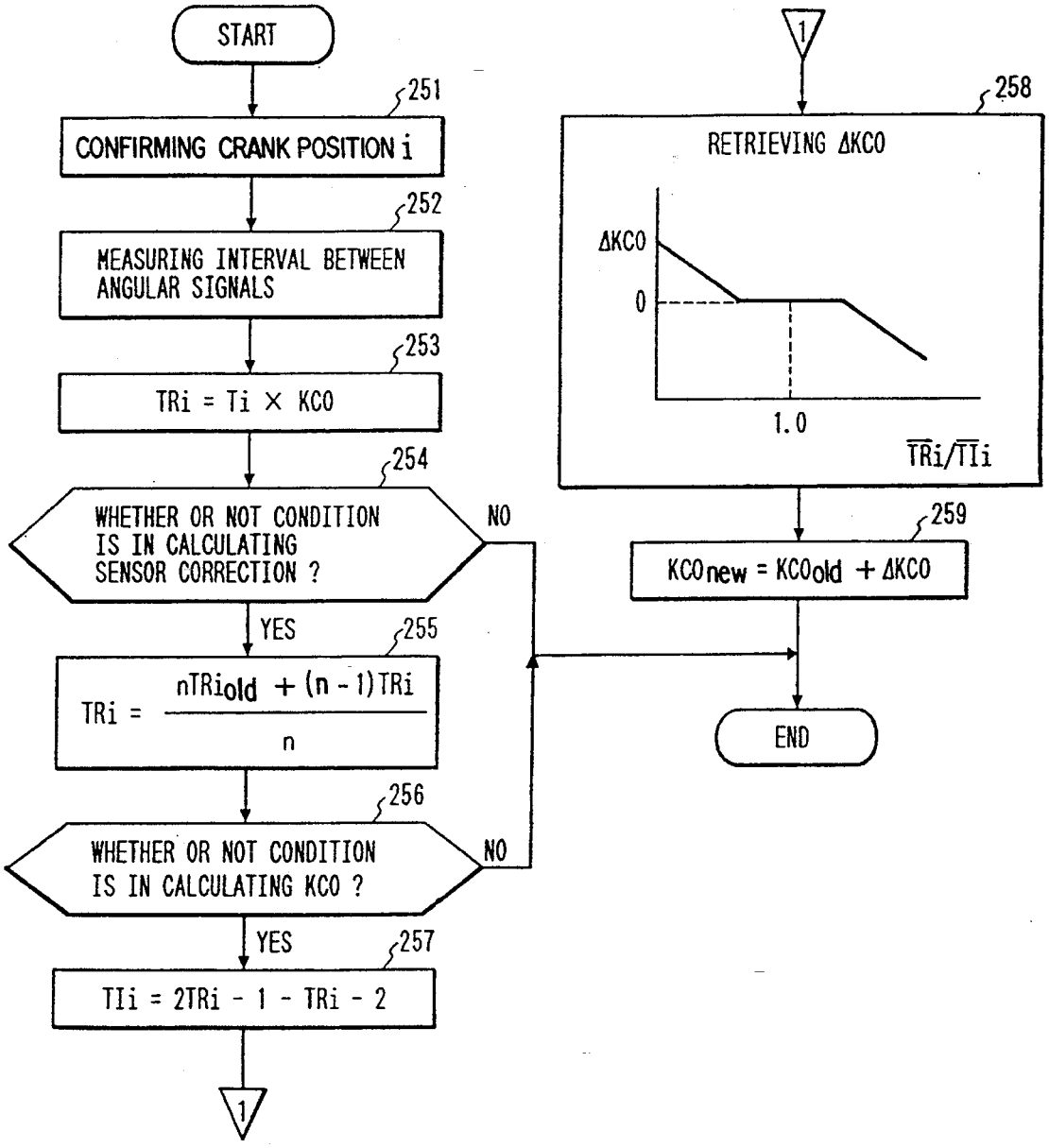
FIG. 26 is a flow-chart showing a further embodiment of a control process executed by an engine controller according to the present invention.

An embodiment of a control process for eliminating such a deviation due to individual differences in a rotation measuring system is shown in the flow-chart of FIG. 26. Firstly, in step 251, the position i in a crank angle displacement to be corrected is confirmed. In step 252, the rotating requiring time $T_i$ between markings at the processing time is measured. In step 253, the measured rotating requiring time $T_i$ is multiplied by a learned value KCO to correct for the deviation due to individual differences, to obtain an average requiring time $TR_I$. Before learning, the learned value KCO is 1. Next, in step 254, it is determined whether conditions exist such that the following processes for learning can be performed. That is, it is required that the operating state of the engine be stable (practically, the engine is not just starting, or during large acceleration or deceleration or the like). When this condition is satisfied, the processing proceeds to step 255, and a new average value $TR_i$ of the average requiring time $TR_i$ is obtained. In this embodiment, weighted mean is used to obtain the average value since the amount of memory used for this purpose is small. With this processing, the irregular error can be almost eliminated.

In step 256, judgment is made whether the average value is reliable (in that the means process in step 255 is performed with a sufficient population to assure accuracy). If so, the processing proceeds to step 257, and a predicted value $TI_i$ of the average requiring time $TR_i$ is obtained by using the and second preceding average value $TR_{i-2}$ and $TR_{i-1}$ of the requiring times. Although the predicted value is obtained through first order interpolation in this embodiment, the number of average values, order or interpolation and method to be used are properly selected depending on the required accuracy. Next, the processing proceeds to step 258, and a correction amount ΔKCO for the learned value KCO is obtained based on the difference between the predicted value $TO_i$ and the measured average value $TR_i$. In this embodiment, the ratio of the values $TR_i/TI_i$ is used as a parameter to retrieve and obtain the ΔKCO from a table shown in the figure. When these values are the same or the difference between them is small (that is, the ratio comes to near unity (one)), the learned value KCO is considered correct, and does not need to be corrected; thus, the correction amount ΔKCO becomes 0 (zero). When the difference between the values is large, the table is used to retrieve a correction amount ΔKCO such that the measured value $TR_i$ approaches the predicted value $TI_i$ since the learned value KCO is not valid. By using the correction amount ΔKCO obtained in such a manner, the learned value KCO is corrected to a new learned value in step 259, and the processing is completed. By performing such a processing every measurement of $T_i$, the learned value KCO which eliminates the deviation due to individual differences, can be obtained.

Although the calculation of combustion stability, in the description above, is based on the rotating angular speed, it is also possible to get the same effect by basing the calculation on the other engine parameters, such as combustion pressure in the cylinder, vibration of cylinder block or change in ignition arc state.

Further, although the air/fuel ratio is controlled with a lean operation in the description above, it is also possible to control exhaust gas recirculation rate, suction air flow rate, ignition timing.

Where provision is made for quantitatively detecting exhaust air/fuel ratio, it is effective to use the air/fuel ratio under a desirable combustion state obtained by the present invention, to eliminate the deviation due to individual differences in the means for detecting the exhaust air/fuel ratio.

In the engine control method and apparatus according to the invention, combustion can be maintained in the desirable state through learning and correcting the deviation due to individual differences in the detector used to detect the combustion state of the engine.

Figure 27:
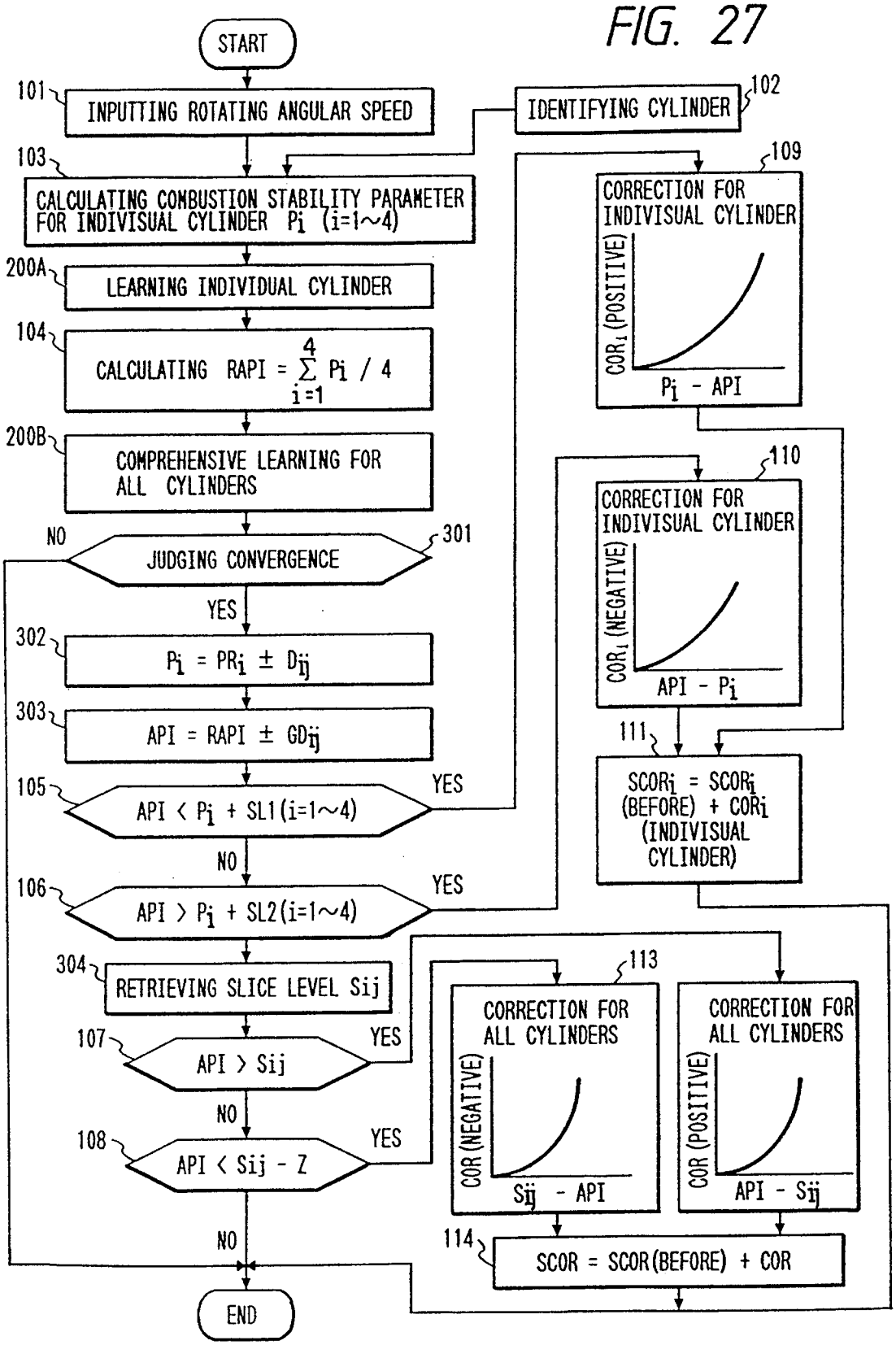
FIG. 27 is a flow-chart showing a further embodiment of a control process executed by an engine controller according to the present invention.

FIG. 27 shows a further embodiment of the invention, which is applied to the engine system shown in FIG. 2 and FIG. 3. In this embodiment, a learning process for correcting the deviation in detectors is added to the control process described above with reference to FIG. 1. Here, the control process steps equivalent to the steps in the above embodiment are given the same reference notations, and the explanations thereof are omitted. The particular processes will be described in detail.

Steps 101 and 102 are performed in the same was as described above. Calculation of the combustion stability $PR_i$ for each of the cylinders in step 103 is performed using actually measured rotating angular speed information. Next, an individual learning process for each of the cylinders is performed in step 200A. The individual learning process 200A is a process performing for each of the cylinders the same procedure described above with referring to FIG. 19. That is, individual cylinder learning maps are provided for each of the cylinders to store or update the individual cylinder learned values $D_{ij}$. In step 104, the combustion stability parameters $PR_i$ for each of the cylinders are summed to calculate a measured over all average value RAPI.

Next, an overall learning process is provided for a state synthesizing all of the cylinders in step 200B, by the same procedure as described above with referring to FIG. 19 and a total learned values $GD_{ij}$ are stored in a total learning map or updated. In step 301, a convergence judgment process is executed. That is, the count value for the number of iterations of learning is compared with a preset value. If the count value is larger than the given value, the processing proceeds to the process in step 302, which the combustion stability parameter $PR_i$ for each of the cylinders is corrected using the individual cylinder learned value $D_{ij}$ to obtain a corrected individual cylinder combustion stability parameter $P_i$. Next, in step 303, the average value RAPI of combustion stability parameters for the total cylinders is corrected using the total learned values $GD_{ij}$ to obtain an average value API of the corrected combustion stability parameters for the total cylinders. The learned values $D_{ij}$, $GD_{ij}$ are retrieved from learning maps in the same way as in the process 221 described above.

The following processes in steps 105, 109, 106, 110 and 11 are performed in the same manner as the processes described above.

When both of the judgments in steps 105 and 106 are "NO", which means that the combustion states in all of the cylinders are substantially the same, processing proceeds to step 304, in which slice level $S_{ij}$ is retrieved. The slice level is used as a base for evaluating the average value of combustion stability parameter to perform a correction control for all of the cylinders. This process is performed in the same way as the process in step 222.

In step 107, the average value API of the corrected overall combustion stability parameter for the total cylinders is compared with the slice level $S_{ij}$. If $API>S_{ij}$, then in step 112 a correction value COR (positive) to shift the air/fuel ratio for all of the cylinders to rich operation is read from a look up table. The correction value COR (positive) in this case varies as a function of the difference between the average value API of the combustion stability parameters and the slice level $S_{ij}$. If $API<S_{ij}-Z$, the processing proceeds to step 113 and a correction value COR (negative) to shift the air/fuel ratio for all of the cylinders to lean operation is read from a look up table. This correction value COR (negative) varies as a function of the difference between the average value API of the combustion stability parameters and the slice level $S_{ij}$.

In step 114, the correction values COR for the total cylinders are added to obtain a new fuel supplying rate.

By repeating such processes, first the deviation of combustion states in the cylinders are decreased to minimize torque fluctuation; then the combustion states in all of the cylinders are set near the lean operation limit, where the demands on the exhaust $NO_x$ and the combustion stability are compatible, and a better fuel cost is obtainable.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A control method for an engine comprising the steps of:

(a) determining combustion state parameters indicating a combustion state in each cylinder of said engine based on fluctuation of rotational speed for an explosion cycle of the respective cylinders;

(b) determining an average combustion state parameter from said combustion state parameters determined for each of the cylinders in order to get information on the overall combustion state;

(c) judging a combustion state in each of the cylinders by comparing said average combustion state parameter with the combustion state parameter determined for each of the cylinders; and (d) controlling the combustion state in each of the cylinders based on results of the judgment.

2. A control method for an engine comprising the steps of:

(a) determining combustion state parameters indicating a combustion state in each cylinder of said engine based on fluctuation of rotational speed for an explosion cycle of the respective cylinders;

(b) determining an average combustion state parameter from said combustion state parameters determined for each of the cylinders in order to get information on the overall combustion state;

(c) judging a combustion state in a particular cylinder is not in a desired state when at least one of the following is true: first a difference between said combustion state parameter of said particular cylinder and said average combustion state parameter exceed a first given value, and second, a difference between said combustion state parameter of said particular cylinder and said average combustion state parameter exceeds a second given value; and (d) controlling combustion states in each cylinder based on results of the judgment for that cylinder.

3. A control method for an engine comprising the steps of:

(a) determining combustion state parameters indicating a combustion state in each cylinder of said engine;

(b) determining an average combustion state parameter from the combustion state parameters determined for each of the cylinders in order to get information on the overall combustion state;

(c) judging a combustion state in each of the cylinders by comparing said average combustion state parameter with the combustion state parameter determined for each of the cylinders;

(d) controlling the combustion state in each cylinder based on results of the judgment; and (e) judging a combustion state for all of the cylinders by comparing said average combustion state parameter with a preset judging value; and (f) controlling the combustion state in all of the cylinders based on results of said judgment for all of the cylinders.

4. A control method for an engine comprising the steps of:

(a) determining combustion state parameters indicating a combustion state in each cylinder of said engine;

(b) determining an average combustion state parameter from the combustion state parameters determined for each of the cylinders in order to get information on the overall combustion state;

(c) determining a combustion state in each of the cylinders by comparing said average combustion state parameter with the combustion state parameter determined for each of the cylinders;

(d) controlling the combustion state in each of the cylinders based on results of the judgment; and (e) judging whether the overall combustion state in all of the cylinders is within a given combustion state region by comparing said average combustion state parameter with a preset first judging value and a preset second judging value; and (f) controlling overall combustion state of all of the cylinders based on the result of said judgement such as to enter into the given combustion state region.

5. An engine controller comprising:

(a) means for determining a combustion state parameter indicating a combustion state in each cylinders of an engine;

(b) means for determining an average combustion state parameter from the combustion state parameters determined for each of the cylinders in order to get information on the overall combustion state;

(c) means for judging a combustion state in a particular cylinder by comparing said average combustion state parameter with the combustion state parameter determined for said particular cylinder;

(d) means for controlling combustion states in each of the cylinders based on results of the combination state judge for that cylinder;

(e) means for judging an overall combustion state of all of the cylinders by comparing said average combustion state parameter with a preset judging value; and (f) means for controlling the overall combustion state of all of the cylinders based on the result of said judgment of an overall combustion state.

6. An engine controller comprising:

(a) means for determining a combustion state parameter indicating a combustion state in each cylinder of an engine;

(b) means for determining an average combustion state parameter from the combustion state parameters determined for each of the cylinders in order to get information on the overall combustion state;

(c) means for judging a combustion state in each of the cylinders by comparing said average combustion state parameter with the combustion state parameter determined for each of the cylinders; and (d) means for controlling the combustion state in each of the cylinders based on results of the judgment;

wherein the combustion state parameter for each of the cylinders is determined based on fluctuation of the engine rotational speed for an explosion cycle of the respective cylinders.

7. An engine controller wherein a combustion state of an engine is quantitatively detected to perform a fuel correction for improving the combustion by comparing said detected value with a pre-stored base value, which controller comprises:

(a) means for determining a parameter indicating the combustion state of the engine;

(b) base value storing means for storing and updating a value of a combustion state parameter determined at any time when the engine is in a base combustion state, for use as a base value; and (c) means for judging degradation of combustion state by comparing said base value stored in the base value storing means with a parameter indicating a combustion state of each cylinder of the engine determined when an operating condition of the engine is in a state to judge a combustion state.

8. A control method for an engine, comprising the steps of:

(a) determining combustion state parameters indicating a combustion state in each cylinder of an engine;

(b) determining and storing a value of respective combustion state parameters determined for each of the cylinders of the engine at any time when an operating condition of the engine is in a base combustion state, as a learned value;

(c) correcting a combustion state parameter indicating a combustion state in each of the cylinders by means of said learned value;

(d) determining an average combustion state parameter from corrected combustion state parameters determined for each of the cylinders in order to get information on the total combustion state;

(e) judging a combustion state in each of the cylinders by comparing said average combustion state parameter with the combustion state parameter determined for each of the cylinders; and (f) controlling the combustion state in each of the cylinders based on results of said judgment.

9. A control method for an engine, comprising the steps of:

(a) determining combustion state parameters indicating a combustion state in each cylinder of said engine;

(b) storing a value of a combustion state parameter determined for each of the cylinders, under a base combustion state, as a learned value;

(c) correcting a combustion state parameter indicating a combustion state in each of the cylinders by means of said learned value;

(d) determining an average combustion state parameter from the corrected combustion state parameters determined for each of the cylinders in order to get information on the total combustion state;

(e) judging a combustion state in each of the cylinders by comparing said average combustion state parameter with the combustion state parameter determined for each of the cylinders;

(f) controlling the combustion state in each of the cylinders based on the results of said judgment of a combustion state in each cylinder;

(g) judging an overall combustion state in all of the cylinders by comparing said average combustion state parameter with a preset judging value; and (h) controlling the overall combustion state of all of the cylinders based on the result of said judgment of said overall combustion state.

10. A control method for an engine wherein a combustion state of an engine is quantitatively detected to perform a fuel correction, to improve combustion of said engine by comparing detected combustion state with a pre-stored base value, which method comprises the steps of:

(a) determining a value of a parameter under a combustion state where an operating condition of said engine is brought into a base combustion state, for use as a new value of a combustion state parameter and updating said pre-stored base value with said new value of the combustion state parameter; and (b) judging degradation of combustion state by comparing said base value with a parameter indicating a combustion state of each cylinder of the engine determined when said engine is in an operating condition for determining a combustion state.

11. A control method for an engine according to claim 10, wherein:

a plurality of said base values are provided corresponding to operating state of the engine.

12. A control method for an engine according to claim 10, wherein:

said base value is determined at a fuel cut-off state.

13. A control method for an engine according to claim 10, wherein:

said base value is determined at a non-load operating state.

* * * * *